United States Patent [19]

Schoppee

[11] 3,995,791

[45] Dec. 7, 1976

[54] CONTINUOUS WEB SUPPLY SYSTEM

[75] Inventor: Lawrence W. Schoppee, Springfield, Mass.

[73] Assignee: Package Machinery Company, East Longmeadow, Mass.

[22] Filed: July 9, 1975

[21] Appl. No.: 594,303

[52] U.S. Cl. ..... 242/58.1; 156/505; 242/75.44

[51] Int. Cl.[2] ..... B65H 19/18; B31F 5/00

[58] Field of Search ..... 242/58.1, 58.2, 58.3, 242/58.4, 58.5; 226/104, 105, 106, 107; 156/502, 504, 505, 506, 507

[56] References Cited

UNITED STATES PATENTS

| | | | |
|---|---|---|---|
| 3,024,157 | 3/1962 | Beerli | 242/58.1 X |
| 3,460,776 | 8/1969 | Stiegler | 242/67.5 X |
| 3,645,463 | 2/1972 | Helm | 242/58.1 |
| 3,669,375 | 6/1972 | Bruton | 242/58.1 |
| 3,813,053 | 5/1974 | Butler | 242/58.4 |
| 3,822,838 | 7/1974 | Butler | 242/75.44 |
| 3,836,089 | 9/1974 | Riemersmg | 242/58.1 |
| 3,891,158 | 6/1975 | Shearon | 242/58.1 |

*Primary Examiner*—Edward J. McCarthy
*Attorney, Agent, or Firm*—McCormick, Paulding & Huber

[57] ABSTRACT

A system for supplying moving web to a web-consuming utilization device, from successively used rolls of web, includes a splicer for splicing the expiring end of a dispensing roll to the beginning end of a ready roll. Between the splicer and the utilization device is a festooner or other web storage device which pays out web before and during operation of the splicer to momentarily stop movement of web through the splicer during splicer operation without effecting the rate of web feed to the utilization device. The web storage device is mechanically driven in the pay out phase of its cycle so that the amount of web paid out follows a fixed web paid out versus drive member displacement schedule, and its operation is positively coordinated with the operation of the splicer and the utilization device to assure the web is stopped in the splicer when the splicer operates, to cause the splice to occur at a desired point along one unit length of the web as consumed by the utilization device, and to enable, when the webs carry repetitively printed patterns, the registration of the pattern of the dispensing roll with the pattern of the ready roll. A web tension control maintains a constant tension in the dispensed web during normal dispensing and brakes the dispensing roll to a stop in the course of a splicing cycle. Means are also provided to facilitate the removal of a spent roll, the installation of a fresh roll, and the setting up of the splicer to splice in the fresh roll during its next operation. The system is useful for example for supplying web to machines for wrapping and packaging sticks of chewing gum or other similar small articles.

31 Claims, 26 Drawing Figures

CONTINUOUS WEB SUPPLY SYSTEM

BACKGROUND OF THE INVENTION

This invention relates to systems or apparatus for supplying webs of paper or other similar material from successively used rolls thereof to an article wrapping machine or any other web-consuming utilization device, and deals more particularly with such a system having the capability of splicing the expiring end of a dispensing roll to the beginning end of a ready roll without slowing down or interrupting the feed to the utilization device and also having the capability of providing a splice having a predetermined location relative to one unit length of web as consumed by the utilization device so that the splice will not fall at a point interferring with the operation of the utilization device or spoiling the appearance or utility of the finished product. It also deals with such a system wherein a repetitive pattern printed on the web of the dispensing roll may be accurately registered with the same pattern printed on the ready roll.

Very basically, the web supply system of this invention is of the general type shown for example by prior U.S. Pat. Nos. 3,645,463 and 3,822,838. Such general systems consist of two reels for supporting respectively a dispensing roll of web and a ready roll of web, a splicer for splicing the expiring end of the dispensing roll to the beginning end of the ready roll, and a festooner or other web storage device located downstream of the splicer and operable to pay out web during the splicing operation to allow the movement of web through the splicer to be temporarily stopped while the splice is made. In prior art systems such as shown by the aforementioned patents, however, the splicing operation is carried out by first braking to a stop the dispensing roll to terminate movement of web through the splicer. During the braking of the dispensing roll the continued pull of the web utilization device increases the tension of the web and this increase in web tension in turn brings the festooner into play to pay out web to the utilization device. Unless some complex photoelectric or other indexing system is provided for controlling the braking of the dispensing roll in response to index marks printed along the length of the web, when the web in the splicer comes to rest, the length of web existing between the splicer and the utilization device is entirely random. This accordingly causes the splice to appear at a random point along one unit length of the web as consumed by the utilization device and prevents controlled location of the splice and controlled registration of any pattern repetitively printed on the web of the dispensing roll with the same pattern on the web of the ready roll. Also, the increase in tension in the web during the splicing operation may cause web breakage problems or problems in the feed of the web to and through the utilization device.

An object of the present invention is, therefore, to provide a web supply system of the general type mentioned having an improved and different form of cooperation between the roll supporting reels, th splicer and the web storage device whereby the pay out of web from the storage device before and during the actual splicing operation is accurately and positively controlled in relation to the feed of web to the utilization device to maintain a controlled displacement of the web through the splicer so when the splicer operates movement of the web through the splicer is stopped with one unit length of the web as consumed by the utilization device having a predetermined position relative to the splicer. Therefore, when the splicer operates on the stopped web the splice made therein will occur at a predetermined point along one unit length of the web and, if necessary, printed matter on the expiring roll may be accurately registered with printed matter on the ready roll. In particular, the improved cooperation is achieved by positively mechanically driving the web storage device in synchronism with the operation of the utilization device. Operation of the storage device is not dependent on the tension in the web passing therethrough. Therefore, this tension may be maintained at a substantially constant value to avoid the possibility of web breakage and to avoid substantial variation in the web tension as supplied to the utilization device. Also, the need for photoelectrical devices and index marks on the web to achieve pattern registration in the course of making a splice is eliminated.

In web supply systems of the general type with which this invention is concerned, after a splice is made it is necessary to remove the spent roll, to install a fresh roll and to condition the system so that when the splicer next operates, it will properly splice the fresh roll to the then dispensing roll to convert the fresh roll to the new dispensing roll. A further object of the invention is accordingly to provide a web supply system of the aforementioned character simplifying the setting up of the system for the making of a subsequent splice ater the completion of one splice. In particular, two roll supporting reels are fixed relative to the splicer and each alternately supports either the dispensing roll or the ready roll. The splicer, in turn, is selectively conditionable to accept the roll of either reel as the dispensing roll, the condition selection being made solely by means of a manually operable two-position selector lever without any replacement, adjustment or modification of other parts being required. Additionally, the splicer is so constructed that the preparation and loading thereinto of the beginning end of the ready roll web may be quickly and easily accomplished without great skill or effort. And either a lap joint or a butt joint may be made depending on the loading procedure.

The system of the inventon includes, for each reel, a roll diameter sensing means, for initiating a splicing cycle when a minimum dispensing roll diameter is reached, including a pivotal sensing arm having a means at its free end adapted to ride against the periphery of the associated roll. In keeping with the objective of facilitating set up of the system for making a new splice after the completion of one splice, a more particular object of the invention is to provide a means whereby a roll is automatically held to or released from the hub of an associated reel in response to the sensing arm of the associated roll diameter sensing means being either in a position of engagement with the roll or in a retracted position allowing removal and replacement of rolls. That is, the reel hub includes a roll chuck which is conditioned to grip a roll when the sensing arm is in sensing position and which is conditioned to release a roll when the sensing arm is in its retracted position. This also reduces the possibility the operator accidentally leaving the sensing arm in retracted position where subsequent sensing of the minimum roll diameter would not take place.

Other objects and advantages of the invention will be apparent from the following description and from the drawings forming a part hereof.

SUMMARY OF THE INVENTION

The invention resides in a web supply system for continuously supplying web from successively used rolls thereof to a utilization device, the system including two reels for rotatably supporting respectively a dispensing roll of web and a ready roll of web, a splicer for splicing the expiring end of the dispensing roll to th beginning end of the ready roll during a cycle of its operation, and a web storage device located downstream with respect to the path of web movement from the splicer and operable to pay out web therefrom during the splicer operation so as to stop movement of web through the splicer without interrupting or slowing down the rate of web feed to the utilization device. Further, the web storage device is positively mechanically driven in synchronism with the utilization device during the paying out of web therefrom. This allows the movement of web through the splicer to be stopped without changing the tension in the web as supplied to the utilization device. It also causes a fixed length of web to pass through the splicer from the instant the paying out operation of the storage device is started until the movement of web through the splicer is stopped. A one-cycle clutch has an input member continuously driven in synchronism with the utilization device and an output member for driving the web storage device and the splicer. The clutch, following arming by the detection of a minimum dispensing roll diameter, engages at a predetermined angular position of the input member so that its output member thereafter moves in synchronism and in phase with the utilization device. Thus, when the web in the splicer is stopped, a unit length of the stopped web has a known position relative to the splicer so that the splice made thereby will occur at a given point along such unit length, a unit length of web being the length of web consumed by the utilization device during one of its operating cycles.

The invention also resides in each of the two reels of the system having a roll supporting hub with a chuck operable in response to movement of a pivotal roll engaging arm of an associated roll diameter sensing means whereby the chuck is conditioned to grip a roll positioned on the hub when the arm is in a roll engaging position and is conditioned to release such roll from the hub when the arm is in a retracted position to which it is manually moved to allow a spent roll to be taken from the hub and a fresh roll to be replaced thereon.

The invention also resides in the splicer of the system having two clamp heads located along and on opposite sides of the path of web movement. Each clamp head has a normal position at which it is spaced away from the web path and it is movable from such normal position toward and through the web path into a clamping relationship with the other of the clamp heads during a splicing operation. That is, during a splicing operation only one of the clamp heads moves and the other remains stationary. Each clamp head includes a series of air ports arranged over its active face and before and during a splicing operation, pressurized air and vacuum are supplied to the air ports at proper times to either attract web to or repel web from the clamp faces. Which of the clamp heads moves during a splicing operation and the schedules of air and vacuum application to the individual clamp heads depends on which of the two reels supports the dispensing roll. A means controlled solely by a manually operable two-position selector lever selectively conditions the splicer to accept either one of the two reels as the dispensing roll supporting reel and to operate the proper clamp head and to properly schedule the application of air and vacuum to both clamp heads during the next splicing cycle.

During the clamping of the two clamp heads one to the other a cut end of the dispensing roll is pressed to a pressure sensitie adhesive coated surface fixed to the beginning end of the ready roll to make the splice. Another aspect of the invention resides in a means for cutting the dispensing roll web immediately prior to the clamping, such means including a pair of movable knives each carried by a respective one of the clamp heads for movement therewith, and a cooperating stationary knife structure.

DETAILED DESCRIPTION OF THE PREFERRED EMBODIMENT

General Organization

Figure 1:
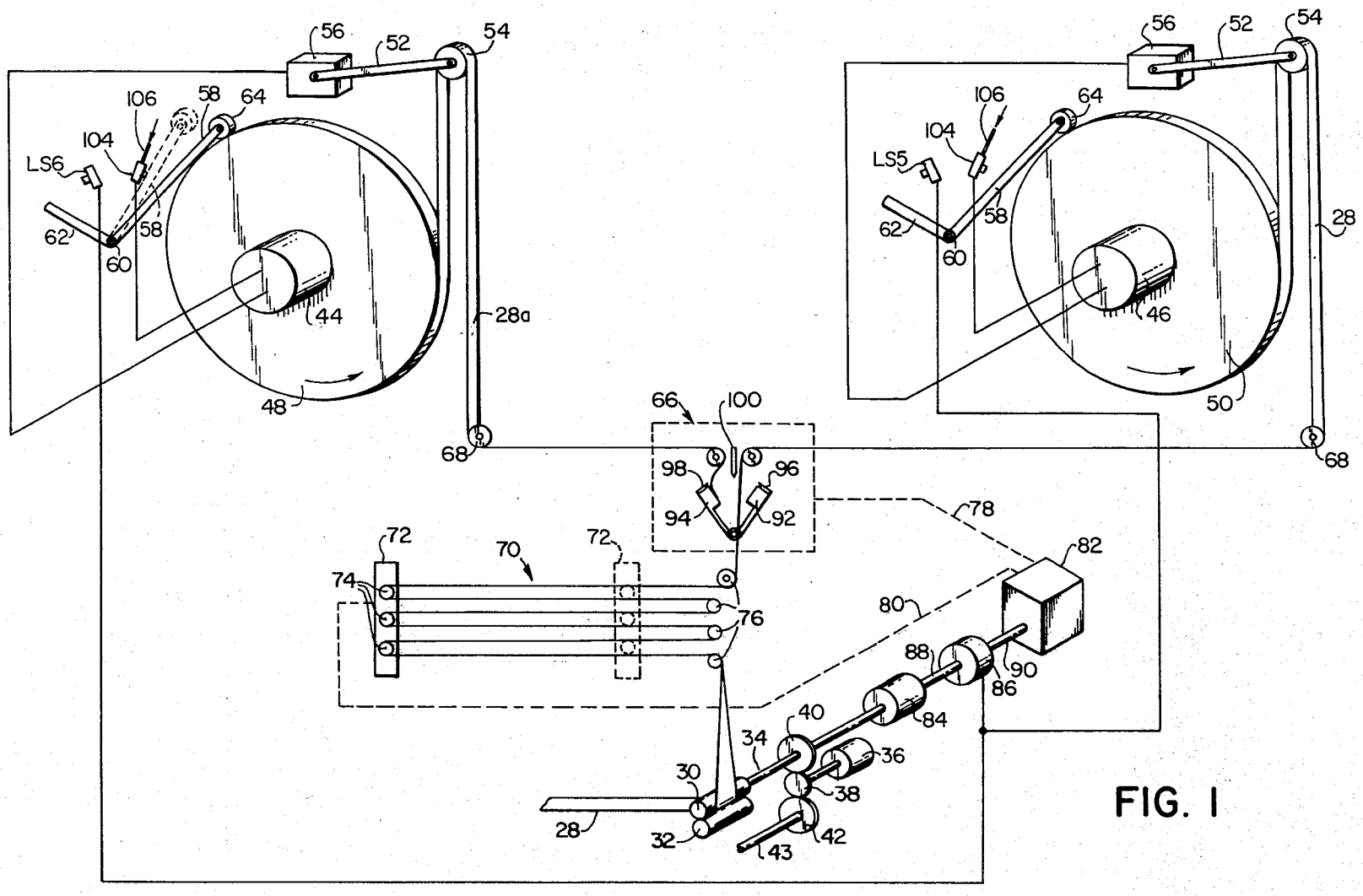
FIG. 1 is a schematic diagram of a complete web system embodying the present invention.

Referring first to FIG. 1, a web supply system embodying this invention is thereshown somewhat schematically and operates to continuously supply a moving web 28 of paper or similar material to a utilization device such as, for example, a machine for wrapping and packaging sticks of chewing gum. In this diagram two feed rolls 30 and 32 are part of the utilization device, and the remainder of the device is not shown and may take a wide variety of forms. The feed roll 30 is driven by a shaft 34 so that for a given angular displacement of the shaft 34 a fixed amount of web 28 is fed into and consumed by the remainder of the utilization device. The shaft 34 is driven in turn by a motor 36 as, for example, through gears 38 and 40, and other portions of the utilization device are driven in synchronism with the shaft 34 as by the illustrated gear 42 and shaft 43. Throughout one cycle of operation of the utilization device, involving for example the wrapping of one stick of gum in the event the utilization device is a gum stick wrapping machine, a unit length of web 28 is fed into the utilization device by the feed rolls 30 and 32 in response to a fixed angular displacement of the feed roll drive shaft 34.

The web supply system of the invention supplies web 28 to the feed rolls 30 and 32 and accomplishes splicing of web from one supply roll to the next without the need for slowing down the rate of web feed to the utilization device and with the splice being made at a predetermined point along a unit length of web as consumed by the utilization device. This web supply system consists of two reels 44 and 46 for rotatably supporting two associated supply rolls 48 and 50 of web. One of these rolls is an active or dispensing roll currently used to dispense web to the utilization device. The other is a ready or standby roll which is subsequently spliced to the expiring end of the dispensing roll to convert it to the dispensing roll. The two reels 44 and 46 alternately and at different times support the ready roll and the dispensing roll. For the time shown in FIG. 1 the right-hand roll 50 is the dispensing roll and the left-hand roll 48 the ready roll.

Each reel 44 and 46 includes a rotatable hub, on which the associated supply roll is mounted, and a tension brake for applying a controlled drag on the hub resisting hub rotation to maintain a desired amount of tension in the dispensed web. In addition to this brake, the web tension control for each reel includes a pivotal arm 52 spring biased upwardly or counterclockwise in FIG. 1 and carrying at its outer end a roll 54 over which the web of the associated roll is trained so that the angular position of the arm is dependent on the tension in the web. An electromechanical sensor or pickoff 56 produces an electrical signal analogous to the web tension, by detecting the angular position of the arm, which in turn controls the energization of the tension brake in the associated reel.

To automatically initiate a splicing operation upon the diameter of the dispensing roll reaching a predetermined minimum diameter, each reel 44 and 46 also has associated therewith a roll diameter sensing means including a pivotal arm 58 pivotally movable about an axis 60 and having a switch operating arm 62 fixed thereto. The outer or free end of the sensing arm 58 carries a roller 64 or similar means which normally engages and rides on the periphery of the associated roll 48 or 50. When the roll reaches a prescribed minimum diameter, the switch operating arm 62 engages and operates an associated limit switch LS5 (in the case of the right-hand reel 46) or LS6 (in the case of the left-hand reel 44).

Both the dispensed web 28 and the ready web 28*a* are guided to a splicer 66 by suitable guide means such as rolls 68, 68. The dispensed web passes through the splicer 66 and downstream of the splicer, before reaching the utilization device, passes through a web storage device in the form of a festooner 70. The storage device has a movable member 72 carrying three web guide rolls 74, 74 which cooperate with four stationary guide rolls 76, 76. As shown in FIG. 1, the web passes over the rolls 74, 74 and 76, 76 in such a manner as to form a number of festoons and the movable member 72 is movable between the solid line and broken line positions of FIG. 1 to vary the length of the festoons and accordingly the length of the stored web.

The splicer 66 and the web storage device 70 are mechanically driven in synchronism with one another, by mechanical linkages indicated diagramatically by the broken lines 78 and 80 respectively, by a cam mechanism 82. The cam mechanism 82 is in turn positively mechanically driven, when operable, in synchronism with the feed roll drive shaft 34 through a gear reducer 84 and a clutch 86. The clutch 86 is a one-cycle clutch in that after it is engaged it will remain engaged throughout one cycle of the cam mechanism 82 and will then disengage to release the cam mechanism from further operation. The clutch has an input shaft 88 and an output shaft 90 which is also the input shaft for the cam mechanism 82. Preferably, and as herein illustrated, the cam mechanism 82 is such that the shaft 90 rotates one revolution for each cycle of the cam mechanism so that the clutch 86 is a one revolution clutch. Also, the clutch includes an arming and an engagement mechanism for initiating engagement of the clutch only when the shaft 88 reaches a prescribed angular position following arming of the clutch so that when the clutch is engaged and the output shaft 90 rotated, the output shaft 90 rotates in phase with the input shaft 88.

The splicer 66 includes two pivotally movable clamp heads 92 and 94. At the time shown in FIG. 1, the clamp head 94 carries the prepared end of the ready web 28a and is locked against movement during the next splicing cycle. When the splicer subsequently operates, the clamp head 92 moves toward and through the path of the dispensed web, cuts the dispensed web and moves the cut end of such web against a pressure sensitive adhesively coated surface fixed to the prepared end of the ready roll web to make the desired splice. For cutting the dispensed web, each clamp head carries a movable knife 96 or 98 which cooperates with a stationary knife structure 100 to perform the web cutting operation during movement of the movable clamp head towards the stationary clamp head.

When, opposite to what is shown in FIG. 1, the left-hand supply roll is the dispensing roll and the right-hand supply roll is the ready roll, the right-hand clamp head 92 is locked in a stationary position and the left-hand clamp head 94 is moved, during the next splicing operation, into clamping relationship with the fixed head 92. A manually operable selector mechanism, hereinafter described in more detail, is provided to enable the operator to selectively condition the splicer in accordance with which of the two rolls is the dispensing roll (right-hand run or left-hand run) so that the proper clamp head is held stationary and the other moved during the subsequent splicing operation.

In a complete splicing cycle, before the dispensed web is cut and before the clamp heads reach their clamped relationship, the festooner or web storage device 70 is operated to pay out stored web, the rate of web pay out being increased until the rate of pay out equals the rate of web consumption by the utilization device, thereby stopping the movement of web through the splicer, this condition of stopped web movement through the splicer being thereafter maintained, by continuing pay out a the rate of web consumption, while the splicer operates to cut and clamp the web. During the paying out of web the movable member 72 of the storage device is positively mechanically moved in synchronism and in phase with the feed roll 30, from the solid line position of FIG. 1 to the broken line position so that the rate of web pay out has a mechanically fixed relationship to the rate of web consumption and so that from the instant of initiating the pay out to the instant web movement through the splicer is stopped a fixed length of web is paid out from the storage device. Following the operation of the splicer the member 72 moves from the broken line position back to the full line position to replenish, to a fixed normal length, the amount of web stored in the storage device in anticipation of the next splicing operation.

The fact that the operation of the web storage device to pay out web is initiated, through the agency of the one-cycle clutch 86, at a fixed or known point along one unit length of the dispensed web, and the fact that a fixed amount of web is paid out of the web storage device from the initiation of the paying out operation to the point at which web movement through the splicer is stopped, assures that the splice made by the splicer will occur at a fixed or known point along a unit length of the web, thereby allowing the location of the splice to be controlled to cause it to fall at a convenient point along a unit length where it will not interfere with the operation of the utilization device or cause appearance or other problems. Also, the known location of the splice along a unit length of web allows a repetitively printed pattern on the web of the dispensing roll to be accurately registered with the same repetitively printed pattern on the web of the ready roll.

Figure 6:
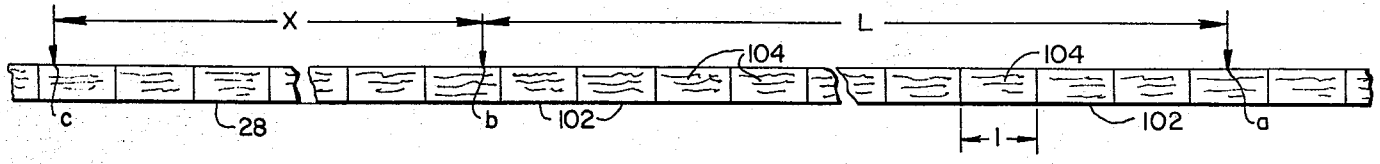
FIG. 6 is a diagram illustrating the movement of web through the splicer from the time a splicing cycle is initiated to the time the movement of the web through the splicer is subsequently stopped, and also explaining the location of the splice at a predetermined point along one unit length of the web.

The known position of the splice occurrence relative to a unit length of web is explained further in FIG. 6. Referring to this figure, the web 28 there shown is divided lengthwise into successive unit lengths 102, 102 each having a length *l*. Each unit length represents the fixed length of web consumed by the utilization device during one cycle of its operation and each unit length may contain one repeat 104, of a pattern printed repetitively along the length of the web. The length L represents the length of web normally existing between the utilization device and the splicer, this length including the amount of web stored in the storage device with the storage device in its fully loaded or replenished condition as it normally is at the beginning of a splicing cycle. The point *a* represents the point along a given unit length of the web at which movement of the web storage device in the pay out mode is initiated. Therefore, at the instant pay out is initiated another unit length of the web will be located in the splicer at point *b*. The quantity X represents the fixed length of web moved through the splicer from the instant of pay out initiation to the time web movement through the splicer is stopped. Therefore, *c* represents the point along another unit length of web at which the splicer is located when the web movement is stopped. Since the point *a* is fixed relative to one unit length of the web and since the lengths L and X are also fixed, the point *c* is likewise fixed relative to another unit length.

After a splicing operation, the old core and the web remnant of the expired web supply roll is removed from its reel and a fresh roll mounted on the reel as the new ready roll. Each reel 44 or 46 includes a chuck for normally gripping and holding the roll received on its hub. During the roll changing procedure the associated roll diameter sensing arm 58 is moved to a retracted position, indicated by the broken lines in FIG. 1, at which it is out of interference with both the old and new rolls to permit the roll change. In this retracted position, the arm 58 engages and shifts an associated air valve 104 which controls the supply of pressurized air from a supply line 106 to a pneumatic operator for the roll chuck. That is, when a roll diameter sensing arm 58 is in its normal position, out of engagement with its air valve 104 and in engagement with the supply roll, air is cut off from the operator for the associated chuck to condition the chuck to grip and hold the roll to the hub; and when the roll diameter sensing arm is in its retracted position, the air supply is turned on by the valve 104 to condition the chuck to release the roll and allow it to be moved from the hub. After a new roll has been placed on a hub, the operator moves the associated roll diameter sensing arm from its retracted position to its normal roll engaging position which shifts the valve 104 back to its off position and automatically causes the fresh roll to be gripped by the chuck and held to the hub. Should the operator accidentally fail to replace the roll diameter sensing arm into engagement with the fresh roll, after the next splice is made and the fresh roll converted to the dispensing roll, rotation of the roll without its chuck engaged will create sufficient wobbling of the roll or other clear evidence of something being amiss as to warn the operator to put the roll diameter sensing arm onto the roll, thereby avoiding the possibility of no minimum roll detection and no consequent splicing operation when the roll unwinds to the minimum desired diameter.

Figure 2:
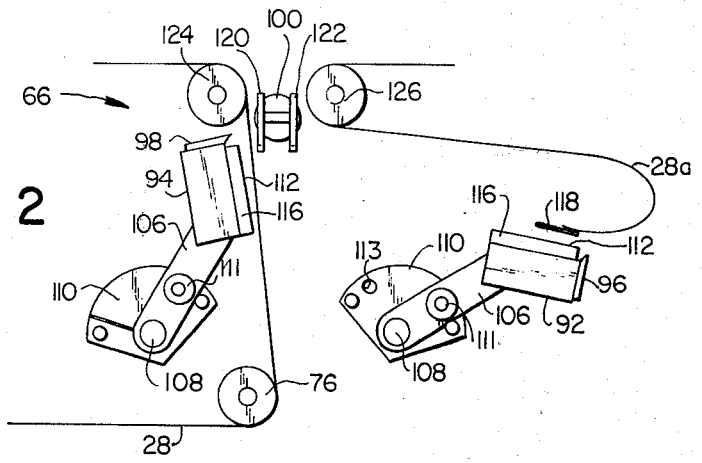
FIGS. 2, 3, 4 and 5 are partial front elevational views of the splicer of the FIG. 1 system showing the splicer clamp heads at different sequential times in the loading of the beginning end of a new roll of web into the splicer and in the subsequent splicing of such beginning end to the expiring end of a dispensing roll.

FIGS. 2 to 5 show the clamp heads 92 and 94 and other parts of the splicer 66 in more detail and in sequence show operation of the splicer through one loading and splicing operation. Each clamp head 92 and 94 is fixed to an arm 106 loosely received on a shaft 108. Fixed to each shaft 108 is a movable driving member in the form of a segment plate 110. Each arm 106 is normally locked to its associated segment plate 110 for movement therewith by a manually releasable locking pin 111 which normally fits into a locking hole 113 of the segment plate, shown in the case of the right-hand segment plate 110 of FIG. 2. In FIG. 2, the left-hand clamp arm 106 is in its normal locked position relative to its segment plate 110 and the right-hand clamp arm 106 is shown in a loading position at which it has been unlocked from its segment plate 110 and swung away from the path of web movement through the splicer to expose and make more accessible the face 112 of its clamp head 92 to allow the beginning end of the web 28*a* of a ready roll of web to be moved onto the face 112. In the illustrated case, it is assumed that the left-hand roll of FIG. 1 is currently dispensing the dispensed web 28 and that a fresh roll of web has been moved onto the right-hand reel and is in the process of being prepared as the ready roll.

Each clamp head 92 and 94 includes a face pad 116 of rubber or other compressible material and air ports are provided in the pad for applying either vacuum or air pressure to the associated clamp face 112. At the time the beginning end of the ready roll is loaded onto a clamp head vacuum is supplied to the air ports of that head to thereafter hold the web fixed to the clamp face until the next splicing operation subsequently occurs. A piece of adhesive tape 118 is attached to the end of the ready web and includes an exposed surface covered with pressure sensitive adhesive which, during the splicing operation, is pressed against the cut end of the dispensed web to form the splice.

Figure 3:
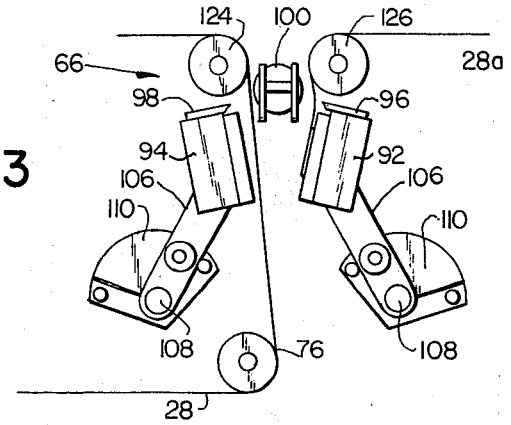

After the prepared end of the ready web is loaded onto its associated clamp head, and held thereto by vacuum, that clamp head is swung back to its normal position and its arm 106 is locked to its segment plate 110 as shown in FIG. 3. The new roll may then be rotated to take up slack between it and the splicer. The two clamp heads thereafter remain in the FIG. 3 position until a splicing operation next occurs.

Figure 4:
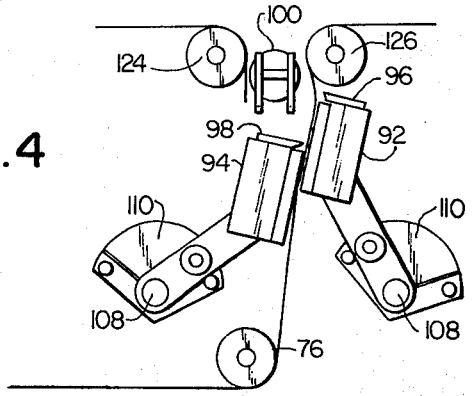

When a splicing operation does next occur, the left-hand clamp head 94 is moved toward and through the path of movement of the dispensing web into engagement with the stationary right-hand clamp head 92, as shown in FIG. 4, by rotation of its associated segment plate 110. The stationary knife structure 100 includes two knife blades 120 and 122 for cooperation respectively with the movable knives 98 and 96 and when the left-hand clamp head 94 is moved from its FIG. 3 position to the FIG. 4 position, its knife 98 cooperates with the knife 120 to sever the dispensing web 28. At the time the cutting occurs, vacuum is also supplied to the air ports of the moving clamp head 94 so that the cut end of the web is attracted to its clamp face 112 and held fixed thereto until reaching clamped engagement with the right-hand clamp head 92.

Figure 5:
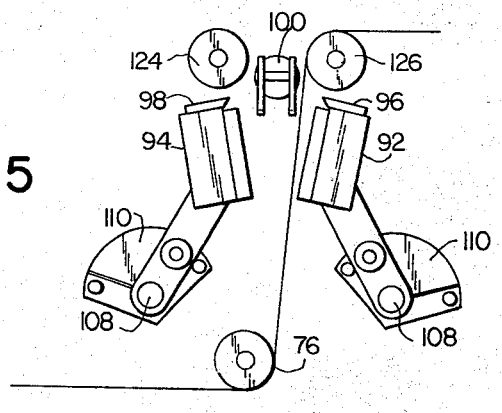

With the two clamp heads in the clamped position of FIG. 4, the cut end of the dispensing web is pressed tightly against the exposed adhesive surface of the adhesive tape attached to the end of the ready web to join the two ends to one another. Thereafter the left-hand clamp head is returned to its normal position, as shown in FIG. 5, with the right-hand roll of web thereafter being the dispensing roll. Subsequent to the step of FIG. 5, the left-hand clamp head is manually unlocked from its segment plate and swung to its loading position and the sequence of FIGS. 2 to 5 is repeated except for the two clamp heads taking opposite roles.

From FIGS. 2 to 5, it should also be noted that web is guided through the splicer by two entrance guide rolls 124 and 126 and an exit guide roll 76. When the left-hand supply roll is the dispensing roll, as in FIG. 3, the guide rolls 124 and 76 define the path of web movement through the splicer and when the right-hand supply roll is the dispensing roll, as in FIG. 5, the guide rolls 126 and 76 define the path of web movement through the splicer. These two alternate paths of web movement through the splicer define a V passing between the clamp heads 92 and 94 and the stationary blade knife structure 100 is located within this V so as to always be positioned on the side of the dispensing web opposite from the clamp head which moves during the next splicing operation and to therefore be properly positioned for cooperation with the moving knife carried by the moving clamp head to perform the cutting operation.

Figure 7:
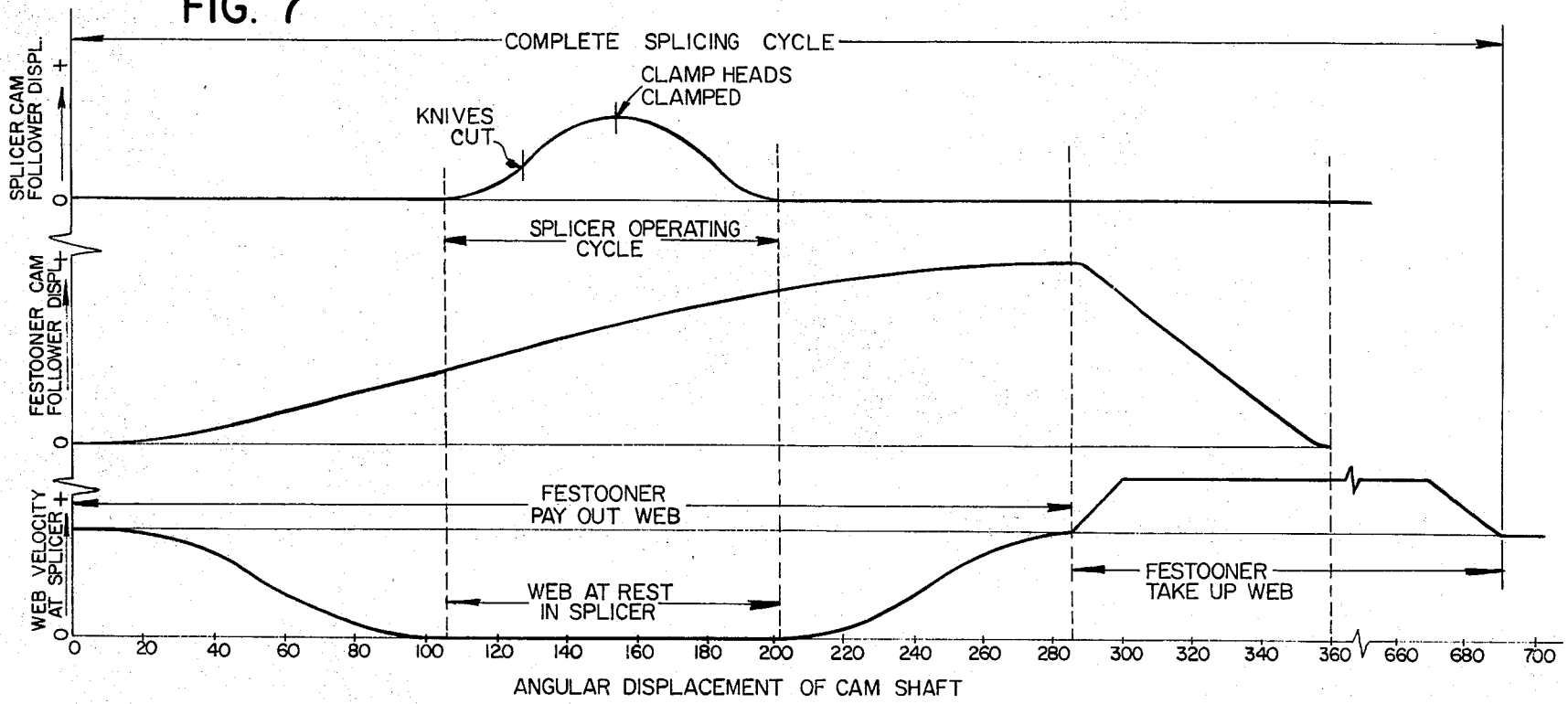
FIG. 7 is a diagram showing the timing of the splicer, the festooner, and the web velocity a the splicer throughout one complete splicing cycle of the system of FIG. 1.

As mentioned, when the clutch 86 of FIG. 1 is engaged the associated cam mechanism 82 is driven through one cycle of its movement to perform a splicing operation. FIG. 7 shows the timing of the splicer 66 and of the web storage device or festooner 70, as well as the velocity of the web at the splicer, throughout a complete splicing cycle. In this diagram, the horizontal axis is the angular displacement of the cam shaft 90. During an initial portion of the rotation of the cam shaft (0° to 106°) the festooner is operated to pay out web at an increasing rate, the rate of pay out being zero at the beginning of the phase and equal to the rate of web consumption at the end of the phase whereby at the end of the phase the web is at rest in the splicer. During the following intermediate phase (106° to 201°) the festooner is operated to pay out web at a steady rate equal to the rate of web consumption so that the web in the splicer remains at rest throughout the full extent of the phase. Also during this intermediate phase the splicer is operated through one of its operating cycles with the movable clamp head being moved from its normal position into clamped relationship with the fixed clamp head and back to its normal position. Following this intermediate phase, the festooner is driven through a deceleration phase (201° to 285°) to gradually decrease the rate of pay out until at the end of such phase the rate of pay out is zero. Subsequent to this deceleration phase, the cam shaft 90 continues to rotate to the end of the revolution, to 360°, and then the clutch 86 releases to terminate its motion. Also following the end of the deceleration phase the festooner 70 is operated in its take up mode to replenish to its normal fixed amount the length of web stored therein. Preferably, as explained and shown hereinafter in more detail, the movement of the festooner during this take up mode of operation is achieved by an air spring or other resilient device which includes a damper for slowing the movement of the movable part 72, and the damper has such a dampening effect that, with the utilization device running at normal speed, the taking up of web extends beyond the time that the displacement of the input shaft 90 reaches 360° and the operation of the cam mechanism is stopped. For example, in the instance shown in FIG. 7, the duration of the take up phase of operation of the festooner is such that the festooner is not returned to its fully loaded normal position until a time equal to approximately 690° of rotation of the cam shaft were the cam shaft to be continued to be rotated beyond one full revolution.

Figure 8:
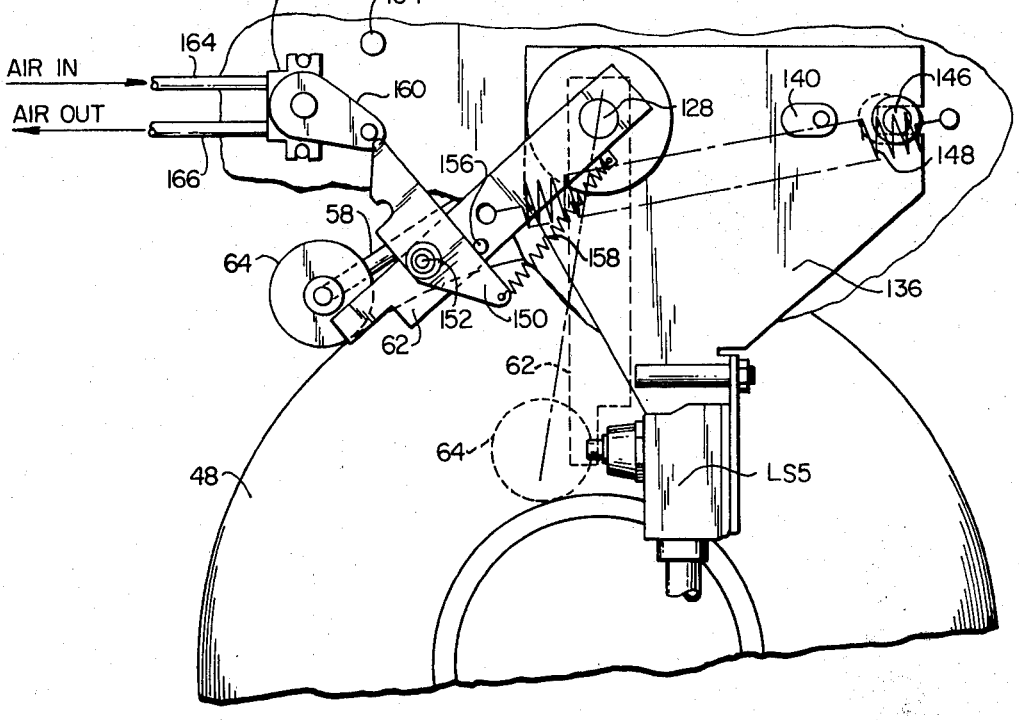
FIG. 8 is an elevational view, looking from the rear thereof, of the roll diameter sensing device associated with one of the reels of the system of FIG. 1, the roll diameter sensing arm being shown in an active position in engagement with a roll.
Figure 9:
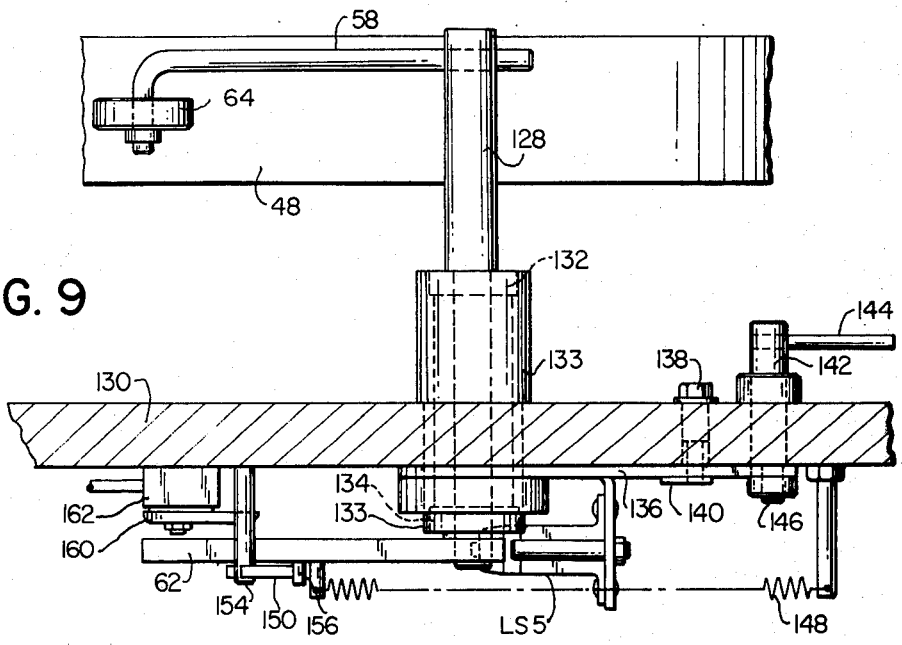
FIG. 9 is a top view of the roll diameter sensing device of FIG. 8.
Figure 10:
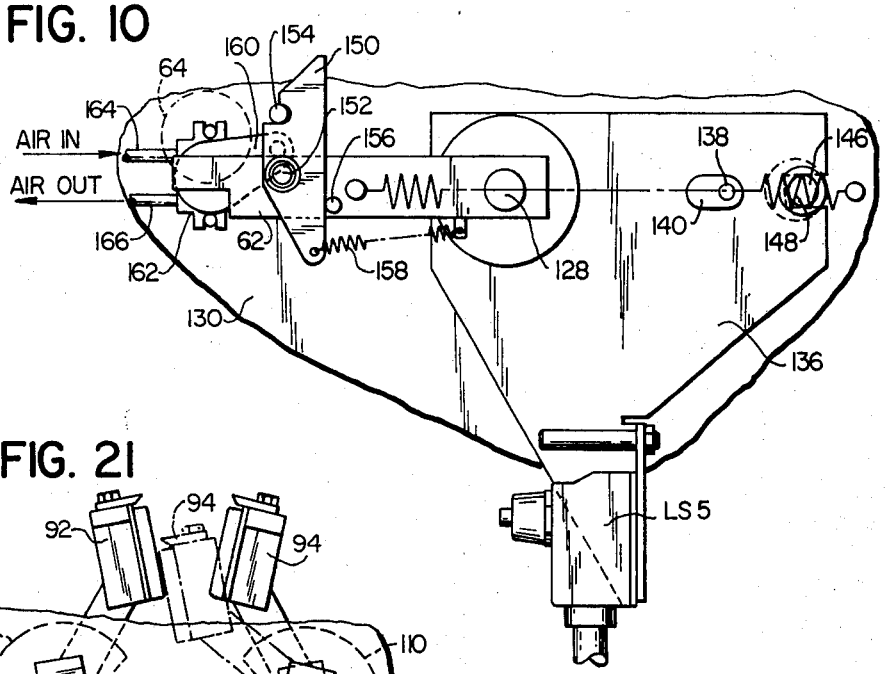
FIG. 10 is a side elevational view similar to FIG. 8 but showing the roll diameter sensing arm moved to its retracted position.

Roll Diameter Sensor FIGS. 8, 9 and 10

FIGS. 8, 9 and 10 show in detail the construction of the left-hand roll diameter sensing means of FIG. 1. The construction of the right-hand roll diameter sensing means is identical to that shown in FIGS. 8, 9 or 10 except for the limit switch LS5 replacing the limit switch LS6.

Referring to FIGS. 8, 9 and 10, the roll diameter sensing means there shown comprises a sensing arm 58 having a free end with a roll engaging roller 64 rotatably mounted thereon. The other end of the arm 58 is fixed to a shaft 128 rotatably supported from a vertical base plate or frame 130 by two bearings 132 and 134 contained in a housing 133 suitably fixed to the base plate. As shown best in FIG. 9, the shaft 128 extends through the base plate 130 and outwardly beyond the bearing 134, and has a switch actuating arm 62 fixed thereto. A switch mounting plate 136 lies flat against the base plate and includes an opening which receives the bearing housing 133, the plate being loosely received on the housing so as to be adjustable to different positions angularly of the axis of the shaft 128. The plate 136 is held in a given position of adjustment by a threaded fastener 138 passing through the base plate and threaded into a nut 140 welded to the outside face of the switch mounting plate 136. When the fastener 138 is loosened, the plate 136 is shiftable to different angular positions by rotation of a shaft 142 provided with an operating lever 144 and having an eccentric nose 146 at its outer end which fits into a slot 148 in the plate 136. The plate 136 carries the limit switch LS5, as shown in FIGS. 8 and 10, and therefore it will be understood that by adjusting the position of the plate 136 as described, the limit switch may be shifted slightly clockwise or counterclockwise about the axis of the shaft 128 from the position shown in FIGS. 8 and 10.

As shown best by the broken and solid line showings of FIG. 8, the switch actuating arm 62 is positioned to engage and trip the limit switch LS5 when the diameter of the associated roll 48 reaches a predetermined minimum diameter. The adjustment of the plate 136 as described above allows the switch to be positioned to vary slightly the minimum diameter at which the tripping occurs to accommodate, for example, different thicknesses of roll cores. The sensing arm 58 is biased toward the roll 48, and likewise the switch actuating arm 62 toward the switch, by a helical tension spring 148 stretched between one post fixed to the switch actuating arm 62 and another post fixed to the base plate 130.

The sensing arm 58 is normally positioned with its roll 64 in engagement with a web supply roll as shown in FIG. 8. However, to enable changing of supply rolls relative to the associated reel, the arm 58 is movable to a retracted position at which it is out of interference with supply rolls during the changing procedure. FIG. 10 shows the sensing arm and its associated switch actuating arm moved to such retracted position. The parts are latched in this position by a latch member 150 pivotally received on a pin 152 carried by the arm 62 and latchingly cooperating with a latch pin 154 fixed to the base plate 130. The latch member 150 is biased counterclockwise, as viewed in FIGS. 8 and 10, toward a stop pin 156 by a spring 158, and as the sensing arm is moved from its normal position to its retracted position the latch member moves automatically into engagement with the latch pin 154 as shown in FIG. 10. For return of the arm 58 to its normal position, the latch 150, due to the shape of the slot therein for receiving the pin 154, disengages when manual pressure is applied to the arm 58.

As the sensing arm is moved from its normal to its retracted position, the switch actuating arm 62 also, as it nears its retracted position, engages and shifts the operating arm 160 of an associated air valve 162. The air valve 162 has an air inlet line 164 and an air outlet line 166. The operating arm 160 is normally biased to the position of FIG. 8 at which the air outlet line 166 is shut off from the air inlet line 164. When the operating arm 162 is shifted upwardly to the position shown in FIG. 10, the valve 162 opens and connects the air outlet line to the air inlet line. Thus, when the sensing arm is in its normal sensing position, air pressure in the outlet line 166 is "off" and when the sensing arm is in its retracted position air pressure in the line 166 is "on". The air in the line 166 in turn operates an associated reel chuck as hereinafter described.

Figure 12:
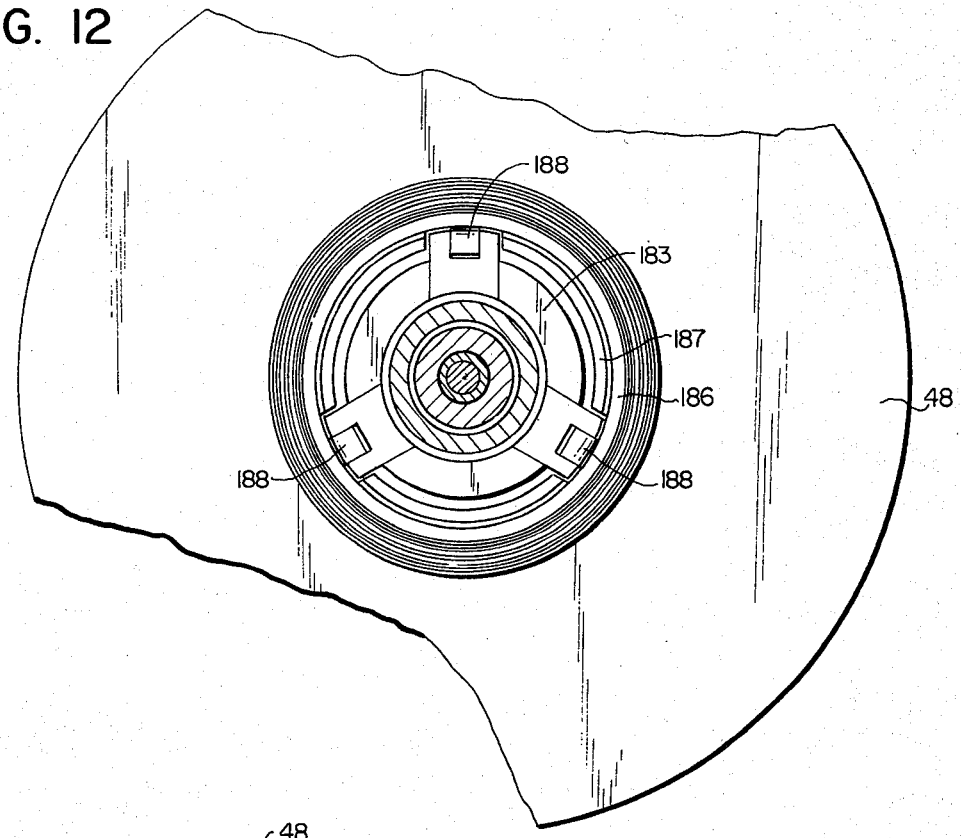
FIG. 12 is a transverse vertical sectional view taken on the line 12—12 of FIG. 11.
Figure 11:
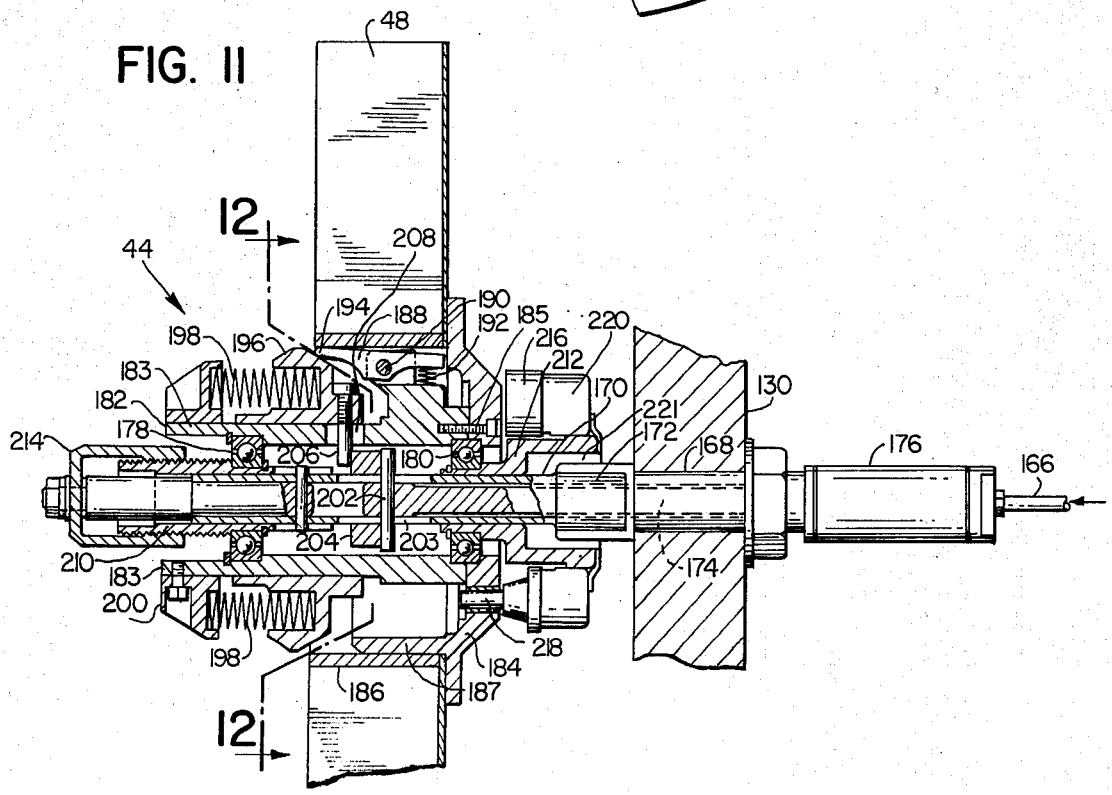
FIG. 11 is a vertical longitudinal sectional view taken through the axis of one of the web reels of the system of FIG. 1.

Roll Reel with Web Tension Control and Roll Chuck FIGS. 11 and 12

FIGS. 11 and 12 show by way of example the construction of the reel 44 of FIG. 1, the construction of the reel 46 of FIG. 1 being identical to that shown by these figures.

Referring to FIGS. 11 and 12, the reel 44 includes an elongated stationary horizontal spindle 168 fixed to the vertical base plate 130. To the left of the base plate 130, in FIG. 11, the spindle includes an enlarged diameter portion having two parallel external flats, one of which is shown at 172. Slidably received in the bore of the spindle 168 is a chuck operating rod 174 driven by a pneumatic chuck operator or air cylinder 176. Rotatably supported on the spindle by two bearing units 178 and 180 is a hub 182 which includes a radially inner part 183 and a radially outer part 184 fixed to one another by a plurality of bolts such as the one shown at 185. The radially outer part 184 includes a cylindrical roll receiving portion 187 over which is normally fitted the core 186 of the supply roll 48 of web. The cylindrical roll receiving portion 187 is interrupted at three points along its circumference, as shown in FIG. 12, and at these points of interruption are three chuck dogs 188, 188 carried by the hub part 183. Each dog 188 is pivotally attached to the hub part 183 by a pin 190, as shown in FIG. 11, and is spring biased by a spring 192 to urge its roll gripping end 194 away from the roll core 186.

The three dogs 188 of the hub are movable between gripping and releasing conditions relative to the core of the roll positioned on the reel by an axially slidable member 196 slidably received on the inner hub part 183. Referring to FIG. 11, when the member 196 is moved to the right it engages the three dogs 188 and urges them radially outwardly into gripping relationship with the roll core. Likewise, when the member 196 is moved to the left in FIG. 11, it allows the spring 192 associated with each dog to move the dog out of gripping relationship with the roll core. The member 196 is urged toward the right in FIG. 11 by a set of springs 198 compressed axially between the member 196 and another member 200 fixed to the radially inner part 183 of the hub.

Normally, when the chuck operator 176 is de-energized, the springs 198 urge the member 196 to the right to hold the dogs 188 in their core gripping position. Movement of the member 196 to the left to unlock or release the dogs from the roll is effected by actuation of the operator 176 which shifts its actuating rod 174 to the left in FIG. 11. At its outer left-hand end the rod 174 carries a cross pin 202 which extends in both directions through a slot 203 in the spindle part 170 and bears against a bushing 204. The bushing surrounds the spindle part 170 and engages a pin 206 fixed to the part 196 and passing through an axially elongated slot 208 in the hub part 183. Actually there are preferably two pins such as the one shown at 206, and two corresponding slots such as the one shown at 208, diametrically opposite from one another, but in FIG. 11 only one is shown for convenience of illustration.

The hub 182 may be shifted axially relative to the stationary spindle to obtain proper tracking of the web dispensed by the roll 48 through the remainder of the system. This axial adjustment of the hub is accomplished by the inner race of the bearing 178 being mounted on a part 210 which is axially slidable on the spindle and by the inner race of the other bearing 180 being mounted on another part 212 which is slidably received on the spindle. The first bearing mounting part 210 is threadably connected with an adjustment knob 214 rotatably fixed to the outer end of the spindle part 170. Thus, when the knob 214 is rotated in one direction or the other the bearing mounting part 210 is axially shifted relative to the spindle in one direction or the other carrying with it the hub 182 and the other bearing mounting part 212.

The reel of FIGS. 11 and 12 also includes a tension brake for providing a variable amount of rotative drag between the hub 182 and the stationary spindle. As shown in FIG. 11, this tension brake includes an armature 216 connected with the hub part 184 by a number of pins, one of which is shown at 218, allowing the armature to slide axially, but fixing it in rotation, relative to the hub. Cooperating with the rotating armature 216 is a stationary field unit 220 fixed to the bearing mounting part 212. The bearing mounting part 212 is in turn held against rotation relative to the spindle 168 by having two flats in its bore 221 which match and engage the flats 172, 172 on the spindle. The field unit 220 is electrically energizable and exerts a variable amount of drag on the rotating armature 216 depending on the degree of such energization. By itself, such tension brake is well known in the art and need not be further described.

One Revolution Clutch and Cam Drive Mechanism for Splicer and Web Storage Device — FIGS. 13 to 18

Figure 13:
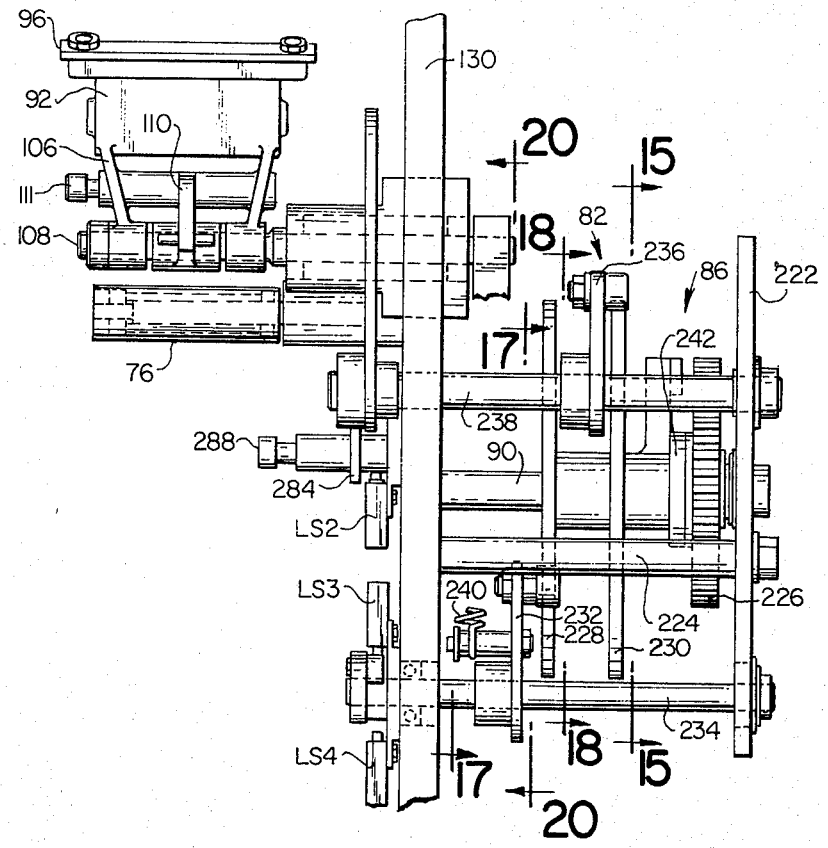
FIG. 13 is a side elevational view of the splicer of FIG. 1 and of the associated one revolution clutch and cam mechanism for driving both the splicer and the web storage device, with various parts of the clutch and cam mechanism being shown broken away or omitted to better reveal the structure of other parts.

Turning to FIG. 13, the one revolution clutch 86 and the cam mechanism 82 are combined with one another as a single unit located between the vertical base plate 130 and a rear plate 222, the rear plate being supported by a number of posts extending horizontally between the base plate 130 and the plate 222, one of which posts is shown at 224. The input drive member for the clutch 86 is a gear 226 rotatably supported on the cam shaft 90. The input gear 226 is the equivalent of the input shaft 88 of FIG. 1 and is directly mechanically connected with the drive motor through suitable other gearing (not shown) for rotation in unison with the utilization device driven by the same motor. The cam shaft 90 has fixed thereto a splicer cam 228 and a storage device cam 230. A follower 232 cooperates with the splicer cam 228 and adjusts the position of an associated shaft 234, to which it is fixed, in accordance with the profile of the cam. Likewise, a follower 236 cooperates with the storage device cam 230 and adjusts the position of an associated shaft 238, to which it is fixed, in accordance with the profile of that cam. A tension spring 240 urges the splicer cam follower 232 into engagement with the splicer cam.

Figure 15:
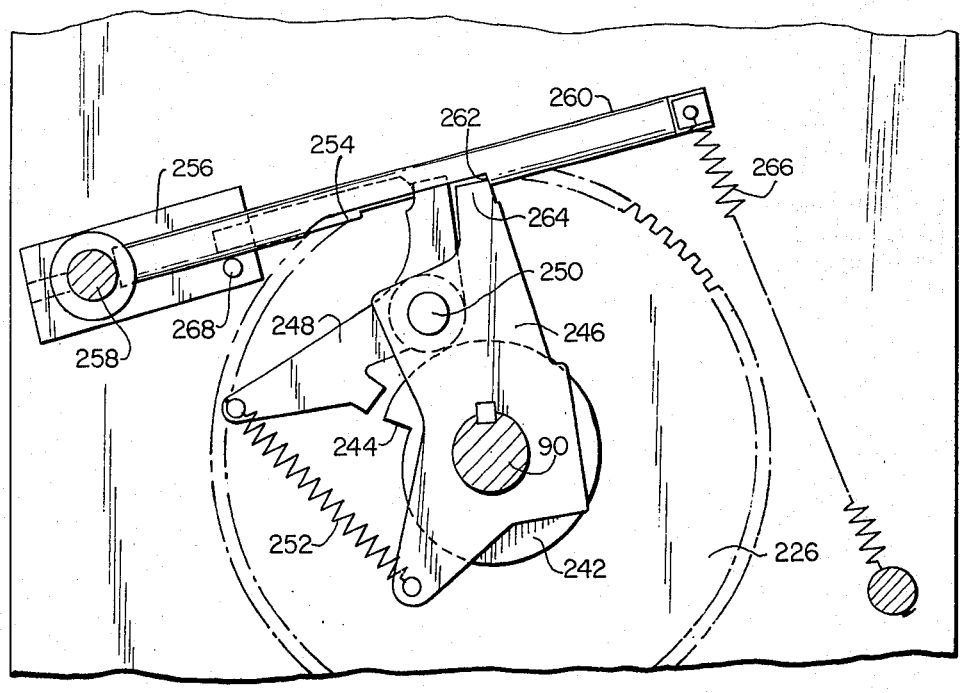
FIG. 15 is a transverse vertical sectional view taken on the line 15—15 of FIG. 13.
Figure 14:
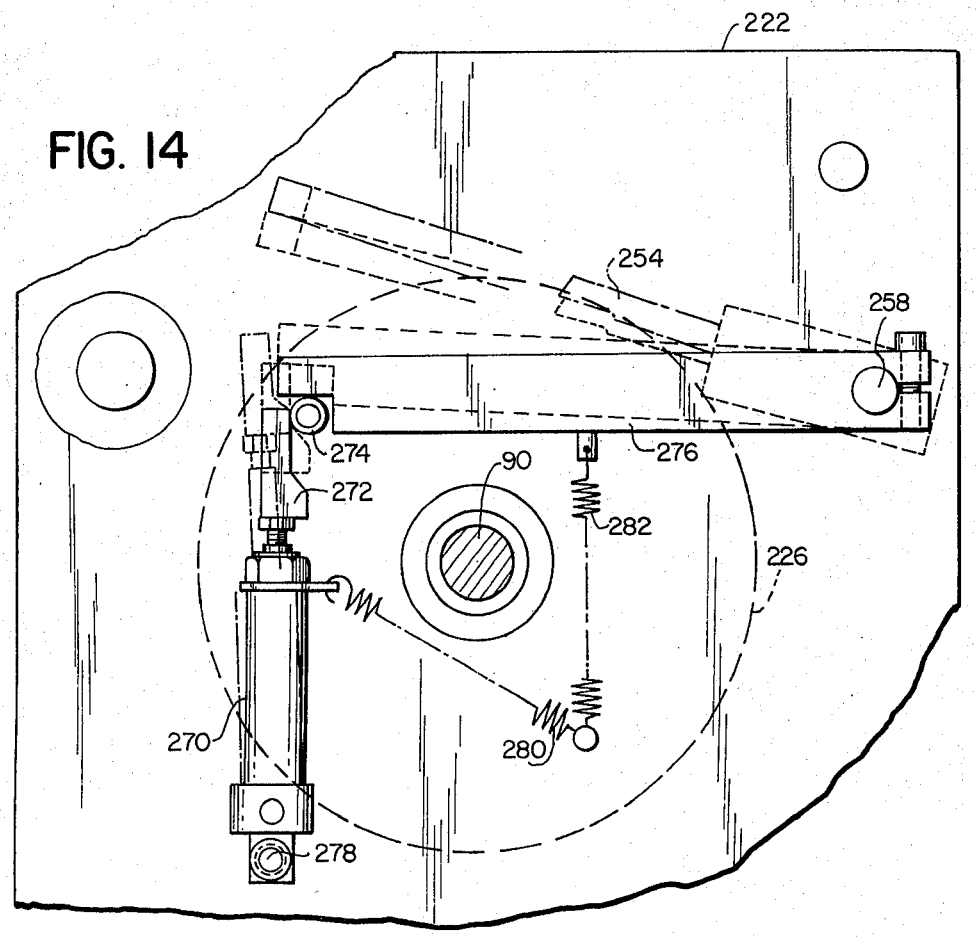
FIG. 14 is an elevational view of the rear or right-hand end of the clutch and cam mechanism of FIG. 13.
Figure 16:
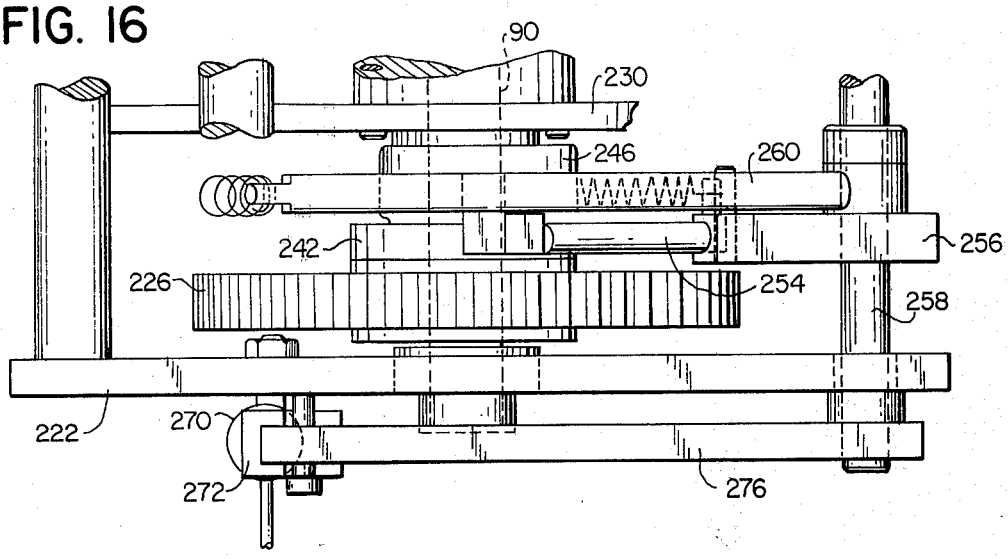
FIG. 16 is a top view of the rear end portion of the clutch and cam mechanism of FIG. 13.

The one revolution clutch, as shown best in FIGS. 14 and 15, includes a ratchet member 242 fixed to the gear 226 for rotation therewith and having a single tooth 244. Keyed to the cam shaft 90 for rotation therewith is a pawl carrier 246 carrying a pawl 248 pivotally connected thereto by a pin 250. The pawl 248 is biased toward the ratchet 242 by a spring 252 stretched between the pawl 248 and the carrier 246, as shown in FIG. 15, but it is normally held out of engagement with the ratchet 242 by engagement with a sear 254. The sear 254 is carried by a block 256 fixed to an arming shaft 258. Also, loosely journalled onto the arming shaft 258 is an anti-backup arm 260. As shown in FIG. 15, the anti-backup arm 260 has an abutment surface 262 which normally engages a finger 264 on the pawl carrier 246 to prevent rotation of the pawl carrier and the cam shaft 90 in the reverse or clockwise direction of FIG. 15 direction. The anti-backup arm is biased clockwise as seen in FIG. 15 by a spring 266 and its movement in the clockwise direction is limited by engagement with a pin 268 carried by the sear block 256.

The arming shaft 258 is moved by a pneumatic arming cylinder 270, shown in FIG. 14, located in back of the mechanism of FIG. 15. In FIG. 14, the solid lines show the parts in their normal positions and the broken lines show the parts in their arming positions. The cylinder 270 has a part 272 on the outer end of its piston rod shaped to engage both a pin 274 fixed to the rear plate 222 and an operating arm 276 fixed to the arming shaft 258. Thus, as the piston rod of the actuator 270 moves from its retracted position ot its fully extended position, the part 272 first engages and moves upwardly or clockwise the operating arm 276, and it then moves out of engagement with the operating arm 276 to allow it to fall back toward the pin 274. From FIG. 14 it will be noted that the operator 270 is pivotally connected at its lower end to the rear plate 222 by a pin 278 and it is urged to hold the part 272 in engagement with the pin 274 by a spring 280. The operating arm 276 is biased counter-clockwise toward engagement with the pin 274 by a spring 282.

Actuation of the cylinder 270 arms the clutch 86. In particular, as the cylinder is operated the part 272 moves upwardly and briefly lifts the operating arm 276 before the part 272 moves off of the arm 276 and allows it to fall back toward its normal position. As the operating arm 276 is raised it rotates the arming shaft 258 and moves the sear 254 out of engagement with the pawl 248, releasing the pawl and allowing it to fall onto the ratchet 242. The pawl thereafter rides on the surface of the ratchet 242 until it is encountered by the tooth 244 at which time the clutch engages and the pawl 248, the pawl carrier 246 and the shaft 90 are rotated with the ratchet 242. The arm 276 does not fall back into engagement with the pin 274 until after the pawl carrier 246 starts to rotate. Until then the sear rests on the pawl 248.

As the pawl carrier 246 completes one revolution, the pawl 248 engages the sear 254, now in its normal position as shown in FIG. 15, which causes the pawl to be raised out of engagement with the ratchet to release the clutch. At the same time, the finger 264 of the pawl carrier moves behind the abutment surface 262 of the anti-backup arm 260, to the position shown in FIG. 15, to again prevent reverse rotation of the pawl carrier and cam shaft and to thereby retain the pawl in its lifted position. Accordingly, it will be understood from the above description, after the clutch is armed by operation of the arming cylinder 270 engagement of the clutch does not thereafter take place until the ratchet tooth 244 engages the pawl 248, and this engagement will always occur at a given point in the rotation of the drive gear 226 which in turn is in phase with the operation of the utilization device, thereby causing clutch engagement to occur only at a given position along one unit length of web consumed by the utilization device.

Figure 17:
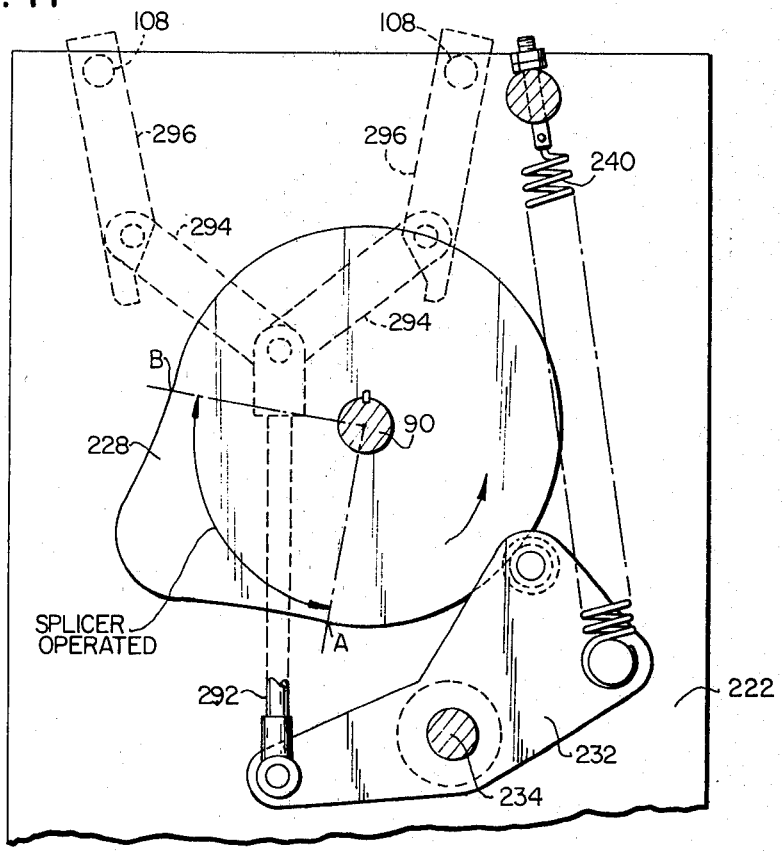
FIG. 17 is a transverse vertical sectional view taken on the line 17—17 of FIG. 13 showing the profile of the splicer cam.
Figure 18:
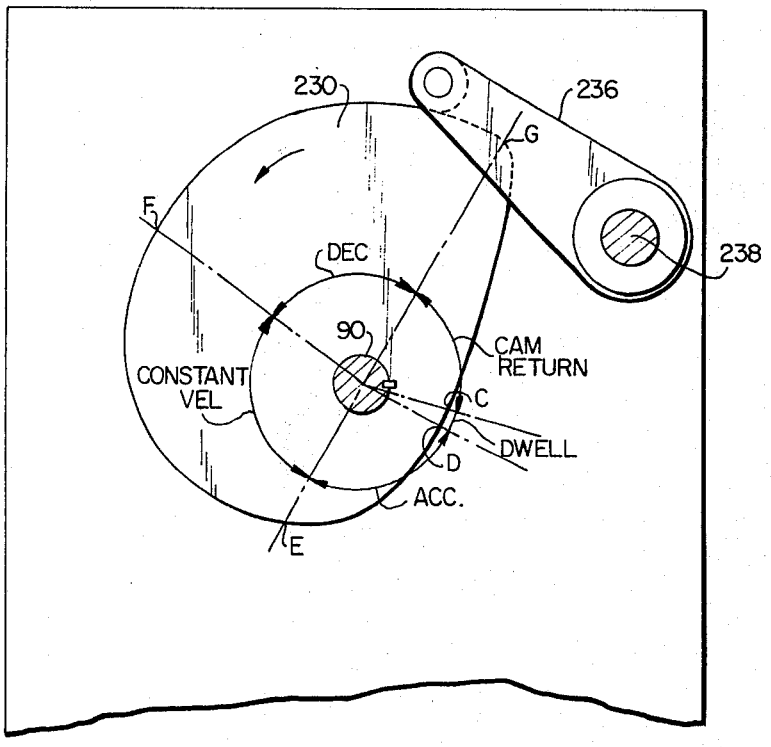
FIG. 18 is a vertical sectional view taken on the line 18—18 of FIG. 13 showing the profile of the storage device cam, the cam shaft in FIG. 18 being shown at a different angular position than in FIG. 17.

Also, of course, as the cam shaft 90 rotates through the one revolution thereof, during the time the clutch is engaged, the two cams carried thereby are rotated to operate both the web storage device and the splicer in the manner previously described generally and as hereinafter explained in more detail. FIGS. 17 and 18 show respectively, the profiles of the splicer cam 228 and the web storage device cam 230. Referring first to FIG. 17, the portion of the splicer cam periphery between point A and point B is the portion thereof corresponding to splicer operation. In FIG. 18, which shows the storage device cam, the point C is the point at which the follower is positioned when the clutch engages. Following this is a small dwell portion, from C to D, throughout which no movement of the storage device takes place. From D to E is an acceleration portion throughout which the storage device is operated in the pay out mode and the rate of web pay out is increased from zero to the rate of web consumption by the utilization device. Between points E and F the cam operates the storage device to pay out web at a constant velocity. Between points F and G the cam operates the storage device to decrease the rate of web pay out from the rate of web consumption to zero. The portion of the cam profile from point G to point C is a return portion, the point G corresponding to a minimum amount of stored web in the storage device and the point C corresponding to a maximum or normal amount of stored web in the storage device.

Splicer — FIGS. 13 and 19 to 24

Referring first to FIGS. 13 to 19 to 21, the splicer 66, in addition to the parts previously mentioned, also includes a selector means for manually conditioning it for operation with either the left-hand supply roll or the right-hand supply roll being the current dispensing roll. This means includes a manually operable selector lever 284 fixed to a shaft 286 and movable between the full and broken line positions of FIG. 19. The lever 284 is releasably lockable in each of its two alternate positions by an axially slidable locking pin 288 carried by the lever. The selector lever 284 is located to the front of the vertical base plate 130. The shaft 286 extends through the base plate and to the rear of the latter carries a two armed keeper 290, as shown in FIG. 20, fixed to the shaft 286 for movement therewith.

Figure 21:
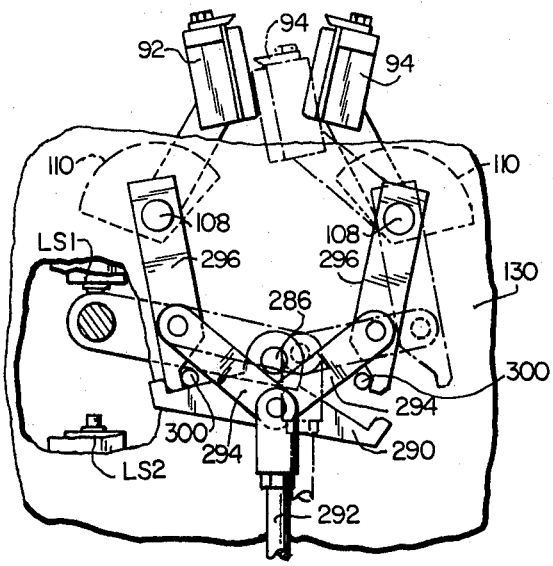
FIG. 21 is a view similar to FIG. 20 but showing the selector mechanism conditioned to enable operation of the left-hand clamp head of FIG. 19.
Figure 20:
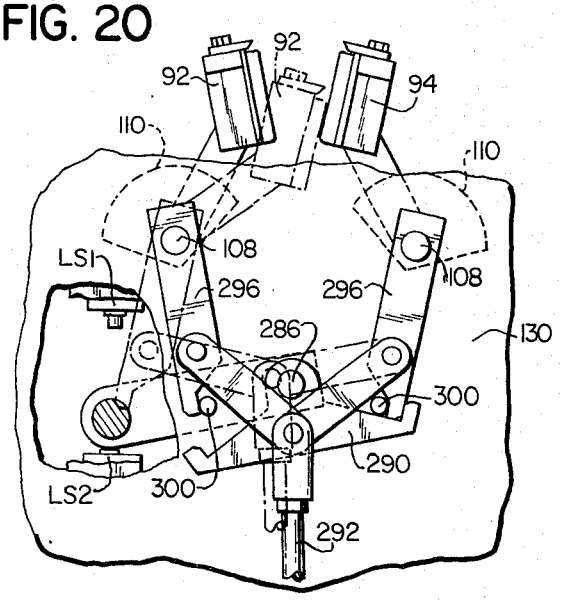
FIG. 20 is a view taken generally on the line 20—20 of FIG. 13, or from the rear of FIG. 19, showing the clamp head operating and selector mechanism of the splicer, the selector mechanism in this view being shown conditioned to enable operation of the right-hand clamp head of FIG. 19.
Figure 19:
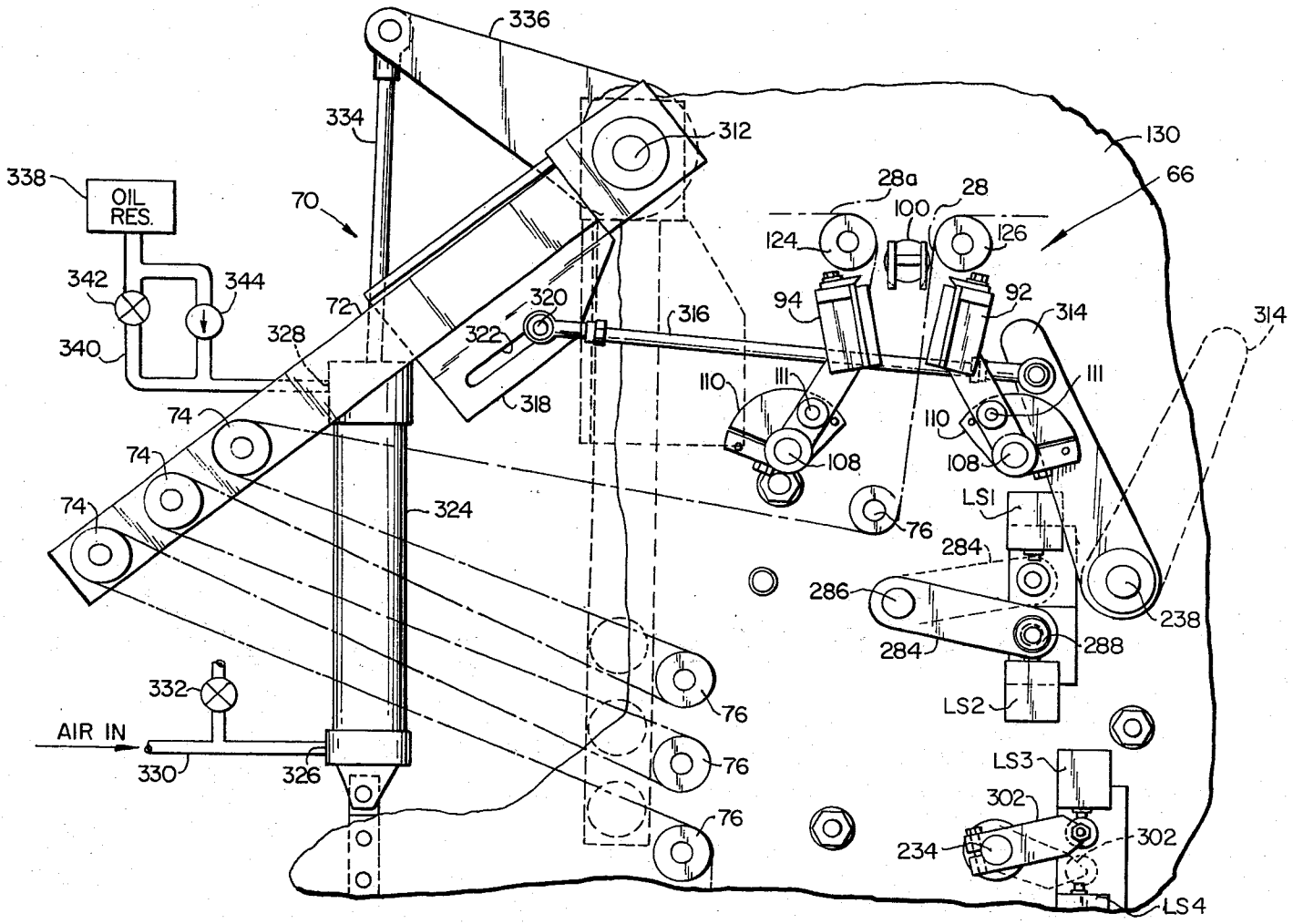
FIG. 19 is a front elevational view of the splicer and of the web storage device of the system of FIG. 1.

FIG. 20, which is a rear view of the splicer as seen in FIG. 19, shows the keeper 290 in the position corresponding to the full line showing of the selector lever 284 in FIG. 19, in which case the splicer 66 is conditioned to accept the right-hand supply roll as the dispensing roll. FIG. 21 is similar to FIG. 20 but shows the keeper in the position corresponding to the broken line showing of the selector lever in FIG. 19, in which case the splicer 66 is conditioned to accept the left-hand supply roll as the dispensing roll.

Referring particularly to FIGS. 20 and 21, and also to FIG. 17, the splicer 66 during a cycle of its operation is driven by a vertically reciprocating rod 292 connected at its lower end to the splicer cam follower 232. At the upper end of the rod are two links 294, 294 each connected between the rod 292 and a respective one of two other links 296, 296. Each link 296 is in turn fixed to a shaft 108 to which is also fixed a respective one of the segment plates 110, 110. Two pins 300, 300 are also fixed to the base plate 130 as shown.

From FIG. 20 it will be evident that when the keeper 290 is in the position shown the lower end of the link 296 associated with the clamp head 94 is locked between the keeper 290 and one pin 300. The other link 296 is, however, free to move and, therefore, when the rod 292 is oscillated vertically between the illustrated full line and broken line positions, the clamp head 92 will likewise be moved between the illustrated full line and broken line positions, the full line position of the clamp head 92 being its normal position and the broken line position being a position of clamping engagement with the fixed clamp head 94.

Likewise, when the keeper 290 is in the position shown in FIG. 21, the link 296 for the clamp head 92 is locked between the keeper 290 and one pin 300 to lock the clamp head 92 against movement, and the other link 296 is free to move. Therefore, when the rod 292 is oscillated, the clamp head 94 is moved between the full and broken line positions shown and the clamp head 92 is held stationary.

Referring to FIG. 19, the splicer 66 also includes two pairs of limit switches for controlling the application of vacuum and air to the clamp heads, and for also controlling other aspects of the system operation, as described hereinafter. The first set of limit switches are the limit switches LS1 and LS2 which are operated by the selector lever 284. That is, the limit switch LS2 is tripped when the lever 284 is in the full line position of FIG. 19 and the limit switch LS1 is tripped when the lever is in the broken line position. The limit switches LS3 and LS4 are the other pair of limit switches and are operated by an operating arm 302 fixed to the shaft 234 to which is also fixed the splicer cam follower 232 of FIG. 17. When the splicer is non-operating, the operating arm 302 is in the full line position of FIG. 19 at which it trips LS3. During the splicer operating cycle, however, the arm 302 is moved away from LS3 and toward LS4 and trips LS4 at substantially the same instant as the clamp heads 92 and 94 move into clamped relationship with one another.

Figure 22:
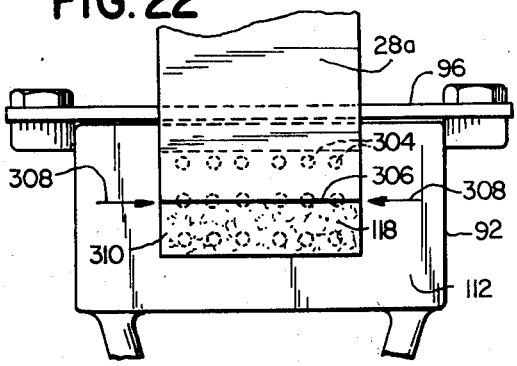
FIG. 22 is a view looking toward the face of one of the clamp heads of the splicer and showing the manner in which the beginning end of the web of the ready roll is positioned on such face in preparation for a subsequent butt joint splicing operation.

FIG. 22 shows the face 112 of the clamp head 92 with the prepared end of the ready web **28*a* positioned thereon in readiness for a subsequent butt joint splicing operation. The clamp head 92 includes a number of air ports, shown at 304, 304**, communicating with the face 112, and at the moment illustrated in FIG. 22 vacuum is applied to these ports to hold the web 28*a* to the face. The cut edge of the web 28*a* is indicated at 306 and is aligned with suitable index marks, such as the ones shown at 308, 308, on the face 112 so that the cut edge will properly mate with the cut edge of the dispensing web during the subsequent operation of the splicer. The adhesive tape 118 is attached to the side of the web 28*a* which is adjacent the clamp head and is of the type having a single pressure sensitive adhesive coated surface. Part of this adhesive surface is adhered to the web 28*a* and the other part, indicated at 310, is exposed for application to the cut end portion of the dispensing web when the two clamps move into engagement with one another.

Figure 23:
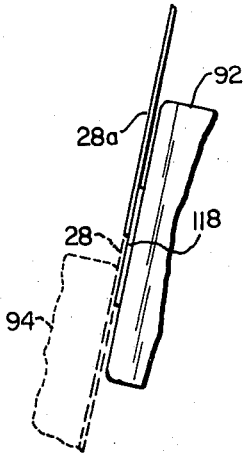
FIG. 23 is a fragmentary side view of the clamp head of FIG. 22. position

FIG. 23 shows the clamp head 92 of FIG. 22 in side elevation in full lines and in broken lines also shows the clamp head 94 in its clamping relationship with the clamp head 92. From this it will be noted that the clamp head 94 carries the cut portion of the dispensing web 28 into such a relationship with the ready web 28*a* and the adhesive tape 118 as to form a butt joint.

Figure 24:
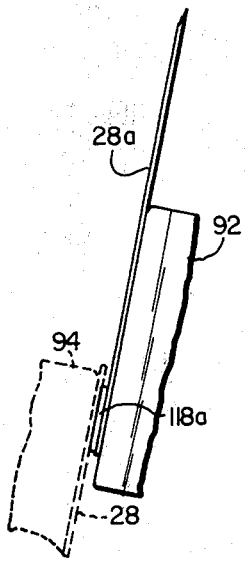
FIG. 24 is similar to FIG. 23 but shows the beginning end of the web of the ready roll positioned on the clamp head in such a manner as to make a lap joint rather than a butt joint.

FIG. 24 is similar to FIG. 23 but shows the ready web 28*a* positioned on the clamp head 92 so as to form a lap joint with the dispensing web 28 when the clamp head 94 moves into clamping relationship therewith as shown by the broken lines. In this case, the adhesive tape 118*a* is fixed to the side of the prepared end of the ready web 28*a* opposite from the clamp head and is of the type coated with a pressure sensitive adhesive on both of its faces.

Although FIG. 22 shows only one clamp head 92, it should be understood that the other clamp head 94 is of a similar construction and likewise includes air ports in and index marks on its face 112.

Web Storage Device — FIG. 19

The web storage device 70, as shown in detail in FIG. 19 and as previously mentioned, includes four fixed web guide rolls 76, 76 and three other guide rolls 74, 74 mounted on a movable arm 72. The arm 72, in particular, is connected with the base plate 130 for pivotal movement relative thereto by a shaft 312 to which it is fixed. The full lines show the arm 72 in the position at which a maximum or normal amount of web 28 is stored in the storage device and the broken lines show the arm in the position corresponding to minimum storage of web.

The arm 72 is moved by a linkage consisting of another arm 314 fixed to the shaft 238 to which is also fixed the splicer cam follower 236 as shown in FIG. 18. A rod 316 is pivotally connected to the free end of the lever 314 and extends between it and a bracket 318 fixed to the arm 72. The left-hand end of the rod 316 is pivotally connected to the bracket 318 by a pin 320 which may be moved and clamped to the bracket 318 in various different positions along the length of a slot 322. That is, the pin 320 is normally fixed to the bracket 118 but it may be unloosened and adjusted to other positions along the length of the slot 322 and then reclamped in the new adjusted position. Varying the position of the pin 320 will vary the excursion of the arm 72 during a splicing operation and will accordingly adjust the amount of and rate of web paid out from the storage device during one cycle of its operation. Thus, by this adjustment, slight changes may be made in the rate of web pay out without necessarily changing the profile of the splicer cam, to assure that the web is stopped in the splicer during the splicer operating cycle.

The movable arm 72 of the storage device is biased toward its normal, full line position of FIG. 19, by an air spring system including an air-hydraulic cylinder 324 having an air port 326 at its lower end and a hydraulic port 328 at its upper rod end. Pressurized air is continuously supplied to the air port 326 by a line 330, having a relief valve 332, so that the piston rod 334 is normally urged upwardly to bias in a clockwise direction an arm 336 fixed to the shaft 312. The hydraulic port 328 of the cylinder is connected to an oil reservoir 338 by a line 340 containing a flow control valve 342 and check valve 344 in parallel with one another.

During operation of the storage device 70 in the pay out mode, the arm 72 is moved counterclockwise in FIG. 19 from the full line position toward the broken line position by the storage device cam through the mechanical drive train consisting of the follower 236, follower shaft 238, arm 314 and rod 316. This motion is yieldingly resisted by the cylinder 324 and the piston rod 334 is driven downwardly into the cylinder by the arm 336 thereby drawing oil from the reservoir 338 into the upper end of the cylinder through the check valve 344. After the arm 72 reaches the counterclockwise limit of its movement, corresponding to the point G of the cam profile as shown in FIG. 18 reaching the follower, the air supplied to the bottom end of the cylinder 324 by the line 330 moves the piston rod 334 upwardly. However, the upward movement of the piston rod 334 is dampened by the flow control valve 342 which slows the rate at which oil from the upper end of the cylinder returns to the oil reservoir 338. As a result, as previously indicated in connection with FIG. 7, when the utilization device is operating at a normal speed the time required for the air spring to return the arm 72 to its normal position is greater than that required for the cam 230 to rotate through its return portion and therefore movement of the arm continues after the clutch 86 is disengaged at the end of one revolution. Efficient use is thus made of the cam mechanism since the major portion of the profile of the storage device operating cam 230 is devoted to operating the storage device in the pay out mode during which accurately controlled movement of the arm 72 is required, and only a minor portion of the cam profile is devoted to the return portion during which the storage device is operated in the take up mode and wherein accurate control over the rate of web take up is not necessary.

Figure 25:
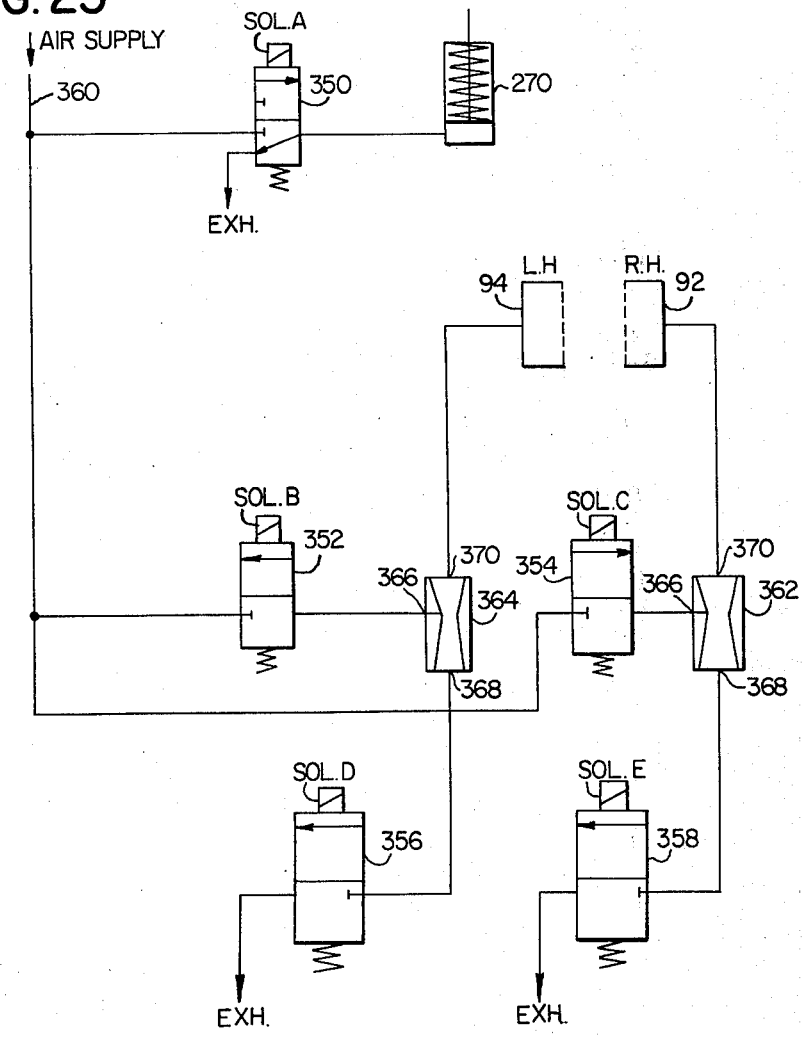
FIG. 25 is a schematic diagram of the system used to supply pressurized air and vacuum to the clamp heads.

Air and Vacuum System — FIG. 25

FIG. 25 shows the system for supplying air and vacuum to the clamp heads 92 and 94 and also to the clutch arming operator 270. In particular, the system includes five solenoid operated valves 350, 352, 354, 356 and 358, the solenoid operators for which are indicated respectively as SOL A, SOL B, SOL C, SOL D and SOL E. The valves are shown in the positions corresponding to the de-energized states of their respective solenoid operators to which positions they are spring biased. The line 360 is the input line for the system and is connected to a suitable source of pressurized air.

The valve 350 controls the application of air to the clutch arming operator 270. The valve 350 is normally positioned to exhaust air from the operator 270 and when SOL A is energized is shifted to supply air thereto.

Associated with the clamp head 92 is a vacuum transducer 362 and a similar vacuum transducer 364 is associated with the clamp head 94. Each transducer has an air inlet port 366, an exhaust port 368 and a controlled port 370. When pressurized air is supplied to an inlet port 366 either a vacuum or air pressure will appear at the associated controlled port 370 depending on whether the related exhaust port 360 is open or closed. The controlled port of each transducer is in turn connected to an associated one of the clamp heads. If pressurized air appears at the inlet port 366 air pressure will also appear at the controlled port 370 and at the associated clamp head if the outlet port 368 is closed. On the other hand, if pressurized air is applied to the inlet port 366 when the outlet port 368 is open, vacuum will appear at the controlled port 370 and at the associated clamp head.

Thus, when SOL B and SOL D are both energized, vacuum is applied to the clamp head 94. If SOL B is energized and SOL D de-energized, pressurized air rather than a vacuum is applied to the clamp head 94. Similarly, if SOL C and SOL E are both energized vacuum is applied to the clamp head 92 and if SOL C is energized and SOL E de-energized, air pressure is applied to the clamp head 92.

Figure 26:
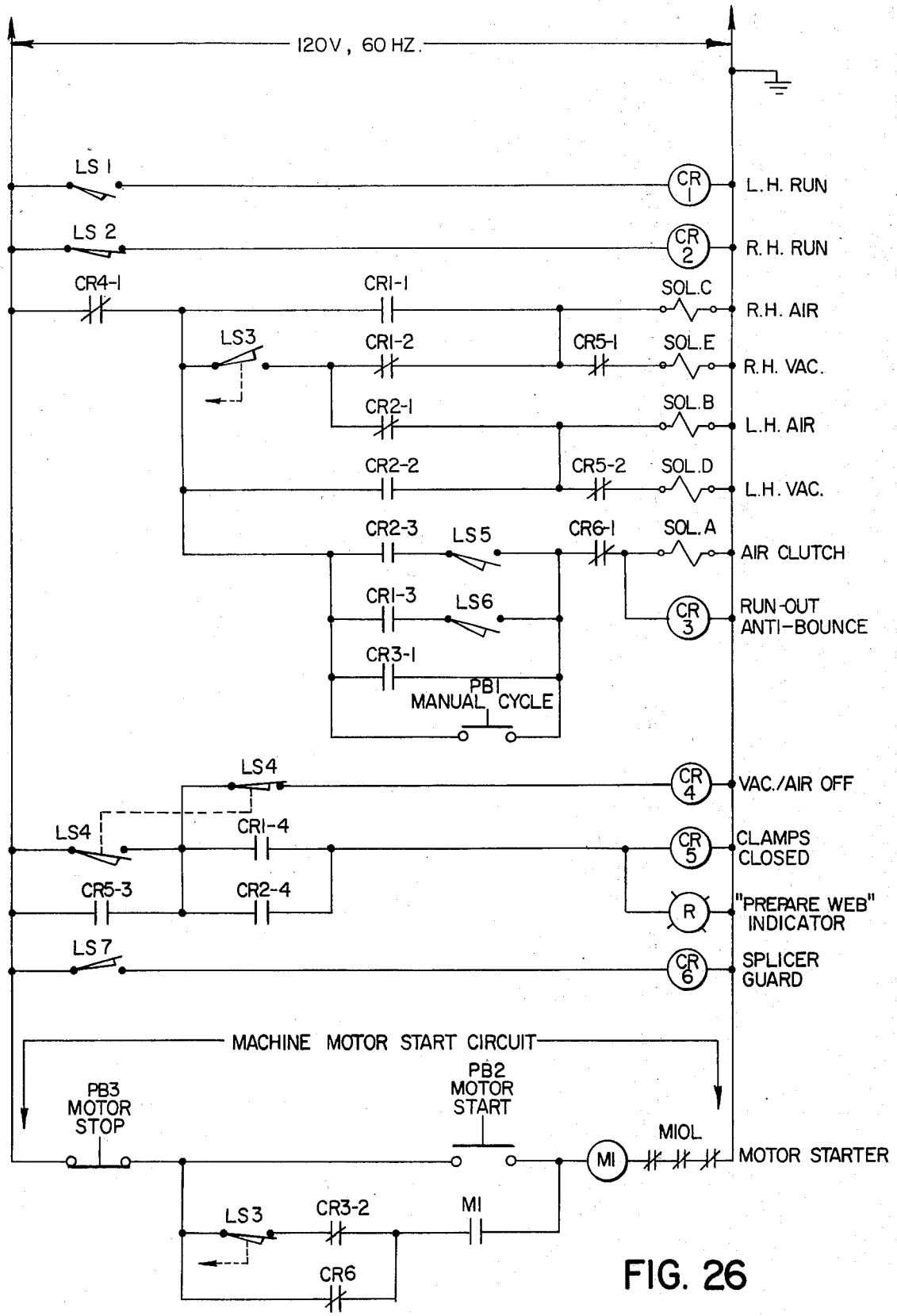
FIG. 26 is a schematic diagram of the electrical circuit forming a part of the system of FIG. 1.

Electrical System — FIG. 26

The electrical control circuit for the system of FIG. 1 is shown in FIG. 26 and consists of the components there shown arranged and interconnected in the manner illustrated for energization from a 120-volt 60Hz. source.

In addition to the limit switches previously described, the circuit includes control relays CR1, CR2, CR3, CR4, CR5 and CR6 each having one or more sets of associated contacts. The contacts operated by the control relay CR1 are for example indicated at CR1-1, CR1-2, CR1-3 and CR1-4 and the contacts associated with the other control relays are similarly notated. In FIG. 26, the various contacts are shown in their normal conditions corresponding to de-energization of their associated relays.

The motor, such as the motor 36 of FIG. 1, which drives the utilization device or machine, as well as the web supply system, is preferably a three-phase motor, and the three serially connected sets of contacts in FIG. 26 collectively identified as M10L are overload contacts each associated with a respective one of the motor phases, a set of these contacts opening in the event of an overload in the associated motor phase.

The limit switch LS7 of FIG. 26 is a switch associated with a guard for the splicer 66. Such guard is not herein otherwise illustrated but consists of a door, housing or other shield which normally encloses the clamp heads 92 and 94, as a safety measure, and which is movable to an open position to allow access to the clamp heads when changing rolls and setting up the splicer for a new roll. The limit switch LS7 is tripped open when the splicer guard is closed and closes when the guard is moved to its open position.

Other parts of the electrical system of FIG. 26 are evident from FIG. 26 and are described further in the following discussion of the operation of the overall system.

System Operation

Having now described in detail the construction of the web supply system of this invention as illustrated in the drawings, its operation may now be described as follows with major reference to the air and vacuum system diagram of FIG. 25, the electrical system diagram of FIG. 26, the general showing of FIG. 1 and the splicer and web storage device illustration of FIG. 19.

For the purpose of this discussion assume that web is being dispensed to the utilization device from the right-hand supply roll 50 mounted on the reel 46. This means that the web selector lever of the splicer is in the right-hand run position causing LS2 to be tripped and energizing CR2. Also, at this time, the splicer is in a non-operating state so that LS3 is tripped. The splicer guard is closed so as to trip open LS7. SOL B and SOL D are energized through now closed contacts CR2-2 to provide vacuum to the left-hand clamp head 94 to hold in place the prepared end of the ready roll web 28*a*.

As the right-hand supply roll 50 dispenses web, it eventually runs down to the minimum diameter at which the associated roll diameter sensing arm 58 positions the switch actuating arm 62 to trip LS5, thereby energizing CR3 and SOL A. Energization of CR3 closes contacts CR3-1 to complete a latching circuit to SOL A to maintain SOL A energized despite possible reopening of LS5 due to an out of round roll periphery (run out) or bouncing of the sensing arm. Energization of SOL A in turn supplies air to the clutch arming cylinder 270 to arm the clutch 86. When the input member of the clutch reaches the start of a new revolution (0° position) the clutch engages and starts one revolution of the cam mechanism 82 to operate the splicer 66 and web storage device 70.

The web storage device arm 72 first begins to move in the web pay out direction and is accelerated to a velocity at which the rate of pay out of stored web is equal to the rate of web consumption by the utilization device, thereby stopping movement of the web through the splicer. During the acceleration of the web storage device, the tension in the web between the dispensing roll 50 and the splicer 66 is reduced, causing the web tension control of the right-hand reel 46 to brake the hub of the reel and stop the rotation of the right-hand supply roll 50 when the web movement through the splicer stops. Due to the timing of the cams the splicer 66 subsequently begins operating with the right-hand clamp head 92 starting to move towards the left-hand clamp head 94 holding the prepared end of the ready roll web 28*a*. This releases LS3 thereby energizing SOL C and SOL E to apply vacuum to the right-hand clamp head 92. The clamp head 92 then engages and cuts the web and the cut end of the web is held fixed thereto by the vacuum.

The right-hand clamp head 92 then moves into a fully closed or clamped relationship with respect to the left-hand clamp head 94 and presses the severed end of the dispensing web carried thereby against the adhesive associated with the prepared end of the ready roll web carried by the clamp head 94, to join the two web ends to one another. Also, as the clamp heads reach their fully closed condition, LS4 is tripped. This tripping of LS4 energizes CR5 and through consequent opening of contacts CR5-1 and CR5-2, de-energizes SOL E and SOL D to transfer pressurized air to both of the clamp heads to aid in releasing the spliced web from the heads and to purge debris, if any, from the clamp head air ports. Tripping of LS4 also energizes pilot light R to provide a visual "prepare web" indication.

The right-hand clamp head 92 now starts to open or move away from the left-hand clamp head 94 and LS4 is released, thereby energizing CR4 and consequently, by opening contacts CR4-1, de-energizing SOL C and SOL B to turn off air to both clamp heads. Opening of contacts CR4-1 also de-energizes SOL A and CR3 to release the clutch arming air cylinder. The right-hand clamp head 92 then reaches its fully open position and trips LS3.

The cam shaft of the cam mechanism 82 then completes its one revolution during which time the movable arm 72 of the web storage device is first decelerated to stop its movement in the pay out direction and then is started in motion in the opposite or web take up direction. Concomitantly with this, as tension is applied to the web between the splicer and the left-hand roll 48, the web tension control associated with the left-hand reel 44 reduces the braking force on the associated hub to allow rotation of the left-hand roll. At the end of the revolution of the cam shaft, the one revolution clutch disengages and is locked against movement until again rearmed. Normally, however, the clutch disengages before the web storage device arm 74 is completely returned to its normal position and its movement in the take up direction continues after the clutch is disengaged with such movement being effected by the air-hydraulic cylinder 324 and controlled by the flow control valve 342.

The operator now begins the installation of a fresh roll of web onto the right-hand reel 46 by opening the splicer guard. This releases LS7, and energizes CR6, to prevent operation of the splicer, by opening contacts CR6-1 to inhibit energization of the clutch arming solenoid, SOL A, until the splicer guard is again closed. The right-hand roll diameter sensing arm 58 is lifted from the expired roll and moved to and latched in its retracted position. As it is lifted from the roll it releases LS5. As it is latched in its retracted position it shifts the associated air valve 104 to apply air to the chuck operating air cylinder of the right-hand reel 46 to release the core of the expired roll from the reel hub. The operator then removes the core and the web remnant of the expired roll from the reel hub and installs a fresh roll onto the hub. The right-hand sensing arm is then unlatched and moved back into engagement with the fresh right-hand roll. This releases the associated air valve 104 to shut off air to the associated chuck operating air cylinder to thereby condition the chuck to grip the core of the fresh roll and hold it in place on the associated hub.

The free end of the web of the fresh right-hand roll is then prepared by cutting it along a transverse line. If the web has a repetitive pattern printed along its length, this line of cut is located at a known point along the length of one repeat of the pattern to obtain registration with the pattern on the dispensing roll in the subsequent splice. A strip of adhesive tape is then applied to the web adjacent the line of cut with the adhesive tape presenting an exposed adhesive surface. The placement of the adhesive tape on the end of the web and the position of the end edge of the web on the clamp head is either as shown in FIG. 23 or in FIG. 24 depending on whether a butt joint or lap joint is desired.

The selector lever 284 is then shifted to the left-hand run position. This releases LS2 and thereby turns off the "prepare web" pilot light R by de-energizing CR2 and opening contacts CR2-4. It also trips LS1, energizing CR1 and thereby applying vacuum to the right-hand clamp head 92 by energizing SOL C and SOL E through contacts CR-1. The locking pin 111 for the clamp head 92 is then withdrawn, to free the clamp head for pivotal movement relative to its segment plate, and the clamp head is shifted to its loading position to fully expose and provide better access to its face 112. The end portion of the web of the right-hand roll is then threaded over its tension sensing arm roll 54 and the other guide rolls to bring its prepared end into the vicinity of the right-hand clamp head face 112, and the line of cut, or a printed register mark or marks on the web, is aligned with an index mark or line on the exposed clamp face. The vacuum thereafter holds the prepared end of the web fixed to the face of the clamp head. The clamp head is then returned to its normal position relative to its segment plate and the locking pin is returned to its locking position to hold the clamp head in such normal position.

The splicer guard is then closed, tripping LS7 and de-energizing CR6 to permit arming of the clutch and subsequent operation of the splicer and web storage device when the left-hand roll thereafter runs down. When the left-hand roll does run down, LS6 of the left-hand roll diameter sensing device trips and a new splicing cycle is initiated which is similar to the one described except that the splice is made to the opposite roll.

While either of the two supply rolls is dispensing, the operator may wish to change over to the other roll before the dispensing roll has completely run down to the minimum roll diameter at which splicing is normally automatically initiated. This can be accomplished by pushing the manual cycle push button PB1 of FIG. 26 which by-passes the limit switches LS5 and LS6 and energizes the clutch arming solenoid SOL A. The splicing cycle thereafter sequences as described above.

As previously mentioned, when the splicer guard is opened, the interlock limit switch LS7 releases and relay CR6 is energized to prevent arming of the clutch and subsequent operation of the splicer. If the splicer guard is opened after a splicing sequence has been initiated and before the clamp heads are returned to their fully opened position to trip LS3, and relay M1 controlling the motor for the entire machine will be de-energized to stop the drive of the machine and in this manner to stop the operation of the splicer.

I claim:

1. A apparatus for supplying web from successively used rolls thereof to a utilization device without interrupting the feed of web to said utilization device when switching the web supply from one of said rolls to the next, said apparatus comprising: a web utilization device, a drive means having a movable output drive member, means positively drivingly connecting said output drive member to said utilization device to drive said utilization device in synchronism with the movement of said output drive member to cause said utilization device to consume web at a rate determined by the rate of movement of said output drive member, two reels for rotatably supporting respectively a dispensing roll of web and a ready roll of web, a splicer operable throughout a cycle of its operation to splice the web of said dispensing roll to the web of said ready roll to convert said ready roll to the next dispensing roll, a web storage device operatively positioned between said splicer and said utilization device, said web storage device being operable in both a pay out mode to decrease the length of web stored therein and in a take up mode to increase the length of web stored therein, and means other than said web positively drivingly connecting said web storage device to said output drive member to drive said web storage device in said pay out mode in synchronism with said utilization device throughout at least one phase of said cycle of splicer operation so as to provide during said phase a rate of pay out of web from said storage device having a fixed relationship with said rate of web consumption by said utilization device.

2. A web supply apparatus as defined in claim 1 further characterized by said means positively driving said web storage device in said pay out mode being so constructed that during said phase of splicer operation the rate of pay out of web from said storage device is equal to the rate of web consumption by said web utilization device, whereby the movement of web through said splicer is stopped during said phase of splicer operation.

3. A web supply apparatus as defined in claim 1 further characterized by means operable following said operating cycle of said splicer for driving said web storage device in said take up mode to replenish the amount of web stored therein.

4. A web supply apparatus as defined in claim 1 further characterized by said means for driving said splicer and said means for driving said web storage device comprising a cam mechanism having a input shaft and two cams drivingly connected with said input shaft, one of said cams being a splicer cam for driving said splicer and the other of said cams being a storage device cam for driving said web storage device, and means including a one-cycle clutch drivingly connecting said output drive member of said drive means to said input shaft of said cam mechanism.

5. A web supply apparatus as defined in claim 4 further characterized by said splicer including means for cutting the web dispensed by said dispensing roll during a cutting operation and means for clamping the cut end portion of said dispensed web to the beginning end portion of the web of said ready roll during a subsequent clamping operation, and said storage device cam being designed so that said web storage device is driven thereby in said pay out mode throughout a schedule including an acceleration phase preceding said splicer cutting and clamping operations during which acceleration phase the rate of pay out of web from said storage device is increased from zero to said rate of web consumption by said utilization device, and an intermediate phase during which said splicer cutting and clamping operations occur and during which said rate of pay out is held steady at said rate of web consumption.

6. A web supply apparatus as defined in claim 5 further characterized by said storage device cam being additionally designed so that web storage device is driven thereby in said pay out mode through a deceleration phase following said cutting and clamping operations during which said rate of pay out is decreased from said rate of web consumption to zero.

7. A web supply apparatus as defined in claim 5 further characterized by means operable following the driving of said storage device in said pay out mode by said storage device cam for driving said web storage device in said take up mode to replenish the amount of web stored therein.

8. A web supply apparatus as defined in claim 7 further characterized by said web storage device including a part movable in one direction to pay out web and movable in the opposite direction to take up web, said means for driving said web storage device including a cam follower in said cam mechanism for following the profile of said storage device cam, a mechanical linkage between said follower and said movable part of said web storage device for moving said movable part in response to movement of said follower, and resilient means for resiliently resisting movement of said movable part of said web storage device in said pay out direction and for driving said movable part in the opposite direction for operation in said take up mode, said storage device cam including a final return portion for which said profile thereof has a beginning point corresponding to minimum stored web and an end point corresponding to maximum stored web, a means for dampening movement of said movable part in the take up direction, the dampening provided by said dampening means being such that at a normal speed of said drive means the time required for said movable part of said web storage device to be moved by said resilient means from a position of minimum stored web to a position of maximum stored web is greater than the time required for said storage device cam to move through said return portion thereof.

9. A web supply apparatus as defined in claim 4 further characterized by said means drivingly connecting said output drive member of said drive means to said input shaft of said cam mechanism including an input shaft for said one-cycle clutch driven in synchronism with said output drive member of said drive means, said one-cycle clutch having an arming member movable between armed and unarmed positions, and means operable when said arming member is in said armed position for positively drivingly connecting said clutch input shaft to said input drive shaft of said cam mechanism throughout one revolution of said clutch input shaft starting at a predetermined angular position of said clutch input shaft and for thereafter releasing said driving connection between said clutch input shaft and said input drive shaft of said cam mechanism at the end of said one revolution of said clutch input shaft.

10. A web supply apparatus as defined in claim 9 further characterized by two roll diameter sensing means each associated with a respective one of said two reels for producing a minimum roll diameter signal when the diameter of the roll mounted on the associated reel reaches a predetermined minimum value, and means responsive to such a minimum roll diameter signal for moving said arming member of said one cycle clutch from its unarmed to its armed position.

11. A web supply apparatus as defined in claim 10 further characterized by each of said roll diameter sensing means including a movable sensing member adapted to normally ride against the outer periphery of a roll supported on the associated reel so that the position of said member is related to the diameter of such roll, said sensing member being movable to a retracted position allowing removal of a spent roll from the associated reel and the substitution of a fresh roll, each of said reels including a hub and a chuck means movable between gripping and releasing conditions for respectively gripping and releasing a roll received on the hub, an operator for moving said chuck between said gripping and releasing conditions, and means for controlling said chuck operator in response to the position of the associated sensing member and in such a manner that said chuck is moved to its releasing condition when said sensing member is in said retracted position and said chuck is moved to said gripping condition when said sensing member is out of said retracted position.

12. A web supply apparatus as defined in claim 4 further characterized by two web tension sensing devices each associated with a respective one of said reels and operatively located between its associated reel and said splicer for providing an analog signal representing the tension of the associated web, and each of said reels including a stationary spindle, a hub rotatably supported by said spindle and adapted to receive a roll of web, and a tension brake, said tension brake being responsive to the signal from the associated web tension sensing means to apply a variable amount of braking force between said spindle and said hub with said braking force increasing as the web tension decreases whereby said tension brake brakes said dispensing roll to stop its rotation when during said cycle of splicer operation the web tension sensed by the associated web tension sensing means becomes substantially zero as a result of the operation of said web storage device temporarily stopping movement of web through said splicer.

13. A apparatus for continuously supplying a moving web to a utilization device, said system comprising: a cyclicly operable web utilization device, two reels for rotatably supporting respectively a dispensing roll of web, dispensing web to said utilization device, and a ready roll of web, a splicer operable throughout a cycle of its operation to splice the web of said dispensing roll to the web of said ready roll to convert said ready roll to the next dispensing roll, a web storage device located immediately downstream, with respect to the direction of web movement, of said splicer and operable in both a pay out mode to decrease the length of web stored therein and in a take up mode to increase the length of web stored therein, a drive means for driving said utilization device, a cam mechanism for driving said splicer and said web storage device, a mechanical drive train between said drive means and said cam mechanism for driving said cam mechanism from said drive means, said mechanical drive train including a one cycle clutch, and said cam mechanism being so constructed that during at least a portion of the operation of said splicer said storage device is driven to pay out web at such a rate as to stop the movement of web through said splicer.

14. A web supply apparatus as defined in claim 13 further characterized by said splicer including two clamp heads located along and on opposite sides of the path of web movement, each of said clamp heads having a normal position at which it is spaced away from said path of web movement and each of said clamp heads being movable from its normal position through said path of web movement and into a clamping relationship with the other of said clamp heads, an actuating member for said splicer, a selector member having two positions, and means responsive to said selector member being positioned in said first position for locking said first clamp head in its normal position and for causing said second clamp head to be moved from its normal position to a clamped relationship with said second clamp head and back again to its normal position in response to one cycle of operation of said actuating member and responsive to said selector member being positioned in said second position for locking said second clamp head in its normal position and for conditioning said first clamp head to be moved from its normal position to a clamped relationship with respect to said second clamp head and back again to its normal position in response to one cycle of operation of said actuating member.

15. A web supply apparatus as defined in claim 14 further characterized by two entrance web guides located in advance of said clamp heads and one exit guide located following said clamp heads, said two entrance guides being spaced from one another and each being used with web from a respective one of said two rolls, whereby the web path when the roll on one of said reels is the dispensing roll and the web path when the roll on the other of said reels is the dispensing roll form a V passing between said clamp heads, a stationary knife means located within said V, and a movable knife means carried by each of said clamp heads, the movable knife means of each clamp head being cooperable with said stationary knife means during movement of the clamp head from its normal position toward clamped relationship with the other of said clamp heads to cut the web of the dispensing roll.

16. A web supply apparatus as defined in claim 14 further characterized by each of said clamp heads having a clamp face facing the opposite clamp head and means defining at least one air port communicating with said clamp face, means for cutting the web of said dispensing roll before the moved one of said clamp heads reaches clamped relationship with the other of said clamp heads during a cycle of operation of said splicer, and means for supplying vacuum to said at least one air port of the moved one of said clamp heads during its movement toward the other clamp head during a cycle of operation of said splicer to cause to to attract and hold the cut end of the web of said dispensing roll and to thereby carry the cut end into engagment with said other clamp head.

17. A web supply apparatus as defined in claim 16 further characterized by means for supplying vacuum to said at least one air port of the clamp head which is locked in its normal position by said selector member prior to operation of said splicer to allow said locked clamp head to hold to its clamp face the beginning end of the web of said ready roll in readiness for the operation of said splicer.

18. A web supply apparatus as defined in claim 16 further characterized by means for supplying positive air pressure to said at least one air port of each of said clamp heads as the moved clamp head moves out of clamping relationship with the locked clamp head and back toward its normal position.

19. A web supply apparatus as defined in claim 14 further characterized by each of said clamp heads having a movable drive member, each of said clamp heads having a clamp face normally facing the opposite clamp head, and each of said clamp heads being pivotally supported on its associated drive member for movement between a normal position with respect to said drive member and a loading position at which the clamp face of said clamp head is exposed for the positioning of the beginning end of the web of said ready roll thereto, means for holding said beginning end of the web of said ready roll to the clamp face of the clamp head onto which it is placed in readiness for the operation of said splicer, and means for releasably locking each of said clamp heads in its normal position with respect to its drive member.

20. A apparatus for continuously supplying a moving web to a utilization device, said system comprising: a cyclicly operable web utilization device which consumes one unit length of web per cycle of operation, means for rotatably supporting a dispensing roll of web and for guiding web from said roll to said utilization device, a means for supporting a ready roll of web, a splicer located along the path of movement of said web of said dispensing roll and operable to splice the web of said ready roll to said web of said dispensing roll to convert said ready roll to the next dispensing roll, a web storage device operatively located between said splicer and said utilization device and which web storage device normally stores a fixed length of web therein so that during normal operation of the said system a fixed length of web exists between said utilization device and said splicer, said web storage device being operable in a pay out mode to decrease the length of web stored therein and also when the amount of web stored therein is less than said fixed amount being operable in a take up mode to replenish to said fixed amount the length of web stored therein, means for initiating operation of said web storage device in said pay out mode at a given point in an operating cycle of said utilization device, and means for operating said splicer when a fixed amount of web has moved through said splicer following the initiation of said operation of said web storage device in said pay out mode.

21. A web supply apparatus as defined in claim 20 further characterized by means for driving said web storage device following the initiation of its operation in said pay out mode in accordance with an operating schedule including an acceleration phase existing during the time said fixed amount of web moves through said splicer following said initiation of the operation of said web storage device and during which acceleration phase the rate of pay out of web from said web storage device is increased from zero to the rate of web consumption by said utilization device whereby the movement of web through said splicer is stopped at the end of the movement of said fixed amount of web therethrough, said operating schedule of said means for driving said web storage device also including an intermediate phase following said acceleration phase during which intermediate phase said rate of pay out of web is held equal to said rate of web consumption by said utilization device, said means for operating said splicer including means for timing said operation of said splicer to occur during said intermediate phase of said operating schedule of said web storage device driving means.

22. A web supply apparatus as defined in claim 21 further characterized by a drive means for said utilization device, and said means for initiating operation of said web storage device at a given point in the operating cycle of said utilization device and said means for driving said web storage device following said initiation comprising a mechanical drive train between said utilization device drive means and said web storage device for driving said web storage device from said utilization device drive means, said drive train including a one revolution clutch having an input shaft, an output shaft, and an arming member movable between armed and unarmed positions, and means operable when said arming member is in said armed position for positively drivingly connecting said input of said clutch to said output of said clutch through one revolution of said input shaft starting at a predetermined angular position of said input shaft and for releasing said driving connection between said input shaft and said output shaft at the end of said one revolution of said input shaft.

23. A web supply apparatus as defined in claim 22 further characterized by a roll diameter sensing means associated with said dispensing roll for producing a signal when the diameter of said dispensing roll reaches a predetermined minimum value, and means responsive to said minimum roll diameter signal for moving said arming member of said clutch from its unarmed to its armed position.

24. A web supply apparatus as defined in claim 20 further characterized by said means for operating said splicer after a fixed amount of web has moved through said splicer following initiation of operation of said web storage device in its pay out mode comprising a first cam for driving said web storage device and a second cam for driving said splicer, and means for moving said first and second cams in unison with one another.

25. In a apparatus for supplying web from successively used rolls thereof, the combination cmprising: two reels for rotatably supporting respectively a dispensing roll of web and a ready roll of web, a web utilization device arranged to consume web from said dispensing roll of web, and a splicer mechanism located between said two reels and said utilization device for splicing the web of said dispensing roll to the web of said ready roll to convert said ready roll to the next dispensing roll, two roll diameter sensing means each associated with a respective one of said two reels for producing a signal when the diameter of the roll mounted on the associated reel reaches a predetermined minimum value, means responsive to such a minimum roll diameter signal for initiating a cycle of operation of said splicer mechanism, each of said roll diameter sensing means including a movable sensing member adapted to ride against the outer periphery of a roll supported on the associated reel so that the position of said sensing member is related to the diameter of said roll, said movable sensing member being movable to a retracted position allowing removal of a spent roll from the associated reel and the substitution of a fresh roll, each of said reels including a hub and a chuck means movable between gripping and releasing conditions for respectively gripping and releasing a roll received on the hub, an operator for moving said chuck means between said gripping and releasing conditions, and means for controlling said chuck operator in response to the position of the sensing member of the associated roll diameter sensing means and in such a manner that said chuck is moved to its releasing condition when said sensing member is in said retracted position and said chuck is moved to said gripping condition when said sensing member is out of said retracted position.

26. In a apparatus for supplying web from successively used rolls thereof, the combination comprising: two reels for rotatably supporting respectively a dispensing roll of web and a ready roll of web, a web utilization device arranged to consume web from said dispensing roll of web, and a splicer mechanism located between said two reels and said utilization device for splicing the web of said dispensing roll to the web of said ready roll to convert said ready roll to the next dispensing roll, said splicer including two clamp heads located along and on opposite sides of the path of web movement, each of said clamp heads having a normal position at which it is spaced away from said path of web movement and each of said clamp heads being movable from its normal position through said path of web movement and into a clamping relationship with the other of said clamp heads, an actuating member for said splicer, a selector member having two positions, and means responsive to said selector member being positioned in said first position for locking said first clamp head in its normal position and for causing said second clamp head to be moved from its normal position to a clamped relationship with said second clamp head and back again to its normal position in response to one cycle of operation of said actuating member and in response to said selector member being positioned in said second position for locking said second clamp head in its normal position and for conditioning said first clamp head to be moved from its normal position to a clamped relationship with respect to said second clamp head and back again to its normal position in response to one cycle of operation of said actuating member.

27. A web supply apparatus as defined in claim 26 further characterized by two entrance web guides located in advance of said clamp heads and one exit guide located following said clamp heads, said two entrance guides being spaced from one another and each being used with web from a respective one of said two rolls, whereby the web path when the roll on one of said reels is the dispensing roll and the web path when the roll on the other of said reels is the dispensing roll form a V passing between said clamp heads, a stationary knife means located within said V, and a movable knife means carried by each of said clamp heads, the movable knife means of each clamp head being cooperable with said stationary knife means during movement of the clamp head from its normal position toward clamped relationship with the other of said clamp heads to cut the web of the dispensing roll.

28. A web supply apparatus as defined in claim 26 further characterized by each of said clamp heads having a clamp face facing the opposite clamp head and means defining at least one air port communicating with said clamp face, means for cutting the web of said dispensing roll before the moved one of said clamp heads reaches clamped relationship with the other of said clamp heads during a cycle of operation of said splicer, and means for supplying vacuum to said at least one air port of the moved one of said clamp heads during its movement toward the other clamp head during a cycle of operation of said splicer to cause it to attract and hold the cut end of the web of said dispensing roll and to thereby carry the cut end into engagement with said other clamp head.

29. A web supply apparatus as defined in claim 28 further characterized by means for supplying vacuum to said at least one air port of the clamp head which is locked in its normal position by said selector member prior to operation of said splicer to allow said locked clamp head to hold to its clamp face the beginning end of the web of said ready roll in readiness for the operation of said splicer.

30. A web supply apparatus as defined in claim 28 further characterized by means for supplying positive air pressure to said at least one air port of each of said clamp heads as the moved clamp head moves out of clamping relationship with the locked clamp head and back toward its normal position.

31. A web supply apparatus as defined in claim 26 further characterized by each of said clamp heads having a movable drive member, each of said clamp heads having a clamp face normally facing the opposite clamp head, and each of said clamp heads being pivotally supported on its associated drive member for movement between a normal position with respect to said drive member and a loading position at which the clamp face of said clamp head is exposed for the positioning of the beginning end of the web of said ready roll thereto, means for holding said beginning end of the web of said ready roll to the clamp face of the clamp head onto which it is placed in readiness for the operation of said splicer, and means for releasably locking each of said clamp heads in its normal position039954730 with respect to its drive member.

* * * * *